US011001058B2

(12) United States Patent
Okuyama

(10) Patent No.: US 11,001,058 B2
(45) Date of Patent: May 11, 2021

(54) METHOD FOR DETERMINING RECORDING TIMING AND RECORDING DEVICE

(71) Applicant: SEIKO EPSON CORPORATION, Tokyo (JP)

(72) Inventor: Tomoyuki Okuyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 8 days.

(21) Appl. No.: 16/724,438

(22) Filed: Dec. 23, 2019

(65) Prior Publication Data

US 2020/0198336 A1 Jun. 25, 2020

(30) Foreign Application Priority Data

Dec. 25, 2018 (JP) ..... JP2018-240836

(51) Int. Cl.
*B41J 2/045* (2006.01)

(52) U.S. Cl.
CPC ..... *B41J 2/04573* (2013.01); *B41J 2/04581* (2013.01)

(58) Field of Classification Search
CPC .. B41J 2/04573; B41J 2/04581; B41J 19/145; B41J 2/01; B41J 29/393; B41J 2029/3935
See application file for complete search history.

(56) References Cited

U.S. PATENT DOCUMENTS

2004/0223032 A1 11/2004 Akase
2008/0143770 A1* 6/2008 Koase ..... B41J 29/393 347/14
2016/0089918 A1* 3/2016 Yokota ..... B41J 29/393 347/14

FOREIGN PATENT DOCUMENTS

JP 2000-158713 A 6/2000
JP 2002-020538 A 1/2002
JP 2003-276172 A 9/2003
JP 2004-243730 A 9/2004
JP 4529396 B2 8/2010
JP 2010-214806 A 9/2010
JP 5293307 B2 9/2013
JP 2015-189180 A 11/2015

OTHER PUBLICATIONS

NPL search (Year: 2021).*

* cited by examiner

*Primary Examiner* — Lisa Solomon
(74) *Attorney, Agent, or Firm* — Global IP Counselors, LLP

(57) ABSTRACT

A method for determining a recording timing includes:
recording patches disposed along a second axis with a recording head; and determining a recording timing of the recording head based on a selected recorded patch; wherein
the patches each include an overlap region, a first region, and a second region; A≥B is satisfied, where A is a width along the second axis of the first region and the second region, and B is a width along the second axis of the overlap region; the width B is recorded decreasing towards both ends along the second axis; and
the recording includes a first recording in which the recording head moves in a first direction along the second axis and the overlap region is recorded with a first nozzle group and the first region is recorded with a third nozzle group, and a second recording in which the recording head moves in a second direction and the overlap region is recorded with a second nozzle group and the second region is recorded with the third nozzle group.

5 Claims, 15 Drawing Sheets

METHOD FOR DETERMINING RECORDING TIMING AND RECORDING DEVICE

The present application is based on, and claims priority from JP Application Serial Number 2018-240836, filed Dec. 25, 2018, the disclosure of which is hereby incorporated by reference herein in its entirety.

BACKGROUND

1. Technical Field

The present disclosure relates to a method for determining a recording timing and a recording device.

2. Related Art

A known recording device is configured to form dots on a medium by moving a recording head provided with nozzles arranged along a first axis along a second axis that intersects the first axis and eject ink droplets from the nozzles according to recorded data. The recording device corresponds to bi-directional recording (hereinafter referred to as "Bi-d recording") in which the recording head alternates between moving along the second axis forward in one direction and back in the other direction. For example, JP-A-2002-205385 describes a recording device that performs a bi-directional adjustment (hereinafter referred to as "Bi-d adjustment") by recording a test pattern of a plurality of straight lines.

Some recording devices use a plurality of different nozzles to form one raster line and perform POL recording. However, when a recording device performs POL recording of a plurality of patches as a test pattern before a Bi-d adjustment, the image with overlap regions that is POL recorded is recorded widened along the second axis. This makes selecting an optimal patch difficult, and may result in Bi-d adjustment based on the selected patch, i.e., the optimum recording timing of the recording head being unable to be determined.

SUMMARY

A method for determining a recording timing according to the present application includes:

recording on a medium a plurality of patches disposed along a second axis intersecting with a first axis with a recording head including a first nozzle group, a third nozzle group, and a second nozzle group arranged in order along the first axis; and determining a recording timing of the recording head based on a patch selected from the plurality of patches recorded on the medium; wherein the plurality of patches each include an overlap region recorded by the first nozzle group and the second nozzle group and a first region and a second region recorded by the third nozzle group;

A≥B is satisfied, where A is a width along the second axis of the first region and the second region, and B is a width along the second axis of the overlap region;

the width B of each overlap region of the plurality of patches is recorded decreasing from a center of the second axis towards both ends; and the recording includes a first recording in which the recording head moves in a first direction along the second axis and the overlap region is recorded with the first nozzle group and the first region is recorded with the third nozzle group, and a second recording in which the recording head moves in a second direction along the second axis and the overlap region is recorded with the second nozzle group and the second region is recorded with the third nozzle group.

In the method for determining a recording timing described above, an amount of ink of the overlap region may be greater than an amount of ink of the first region and an amount of ink of the second region.

In the method for determining a recording timing described above, the plurality of patches may be recorded such that B≥A/2 is satisfied; and the width B of end portion patches disposed on both ends of the plurality of patches may be B=A/2 and may be recorded to be equal to a maximum value of a difference along the second axis between a recording position from the first recording and a recording position from the second recording.

In the method for determining a recording timing described above, the width B of a center patch centrally disposed of the plurality of patches may be recorded such that B=A is satisfied; and along the second axis, the plurality of patches may be recorded to be symmetrical with respect to the center patch.

A recording device according to the present application includes:

a recording head including a first nozzle group, a third nozzle group, and a second nozzle group arranged in order along a first axis, the recording head being configured to record on a medium a plurality of patches disposed along a second axis intersecting the first axis;

a head moving unit configured to cause a carriage, at which the recording head is mounted, reciprocate along the second axis; and a control unit including a recording timing determination unit configured to determine a recording timing of the recording head; wherein the plurality of patches each include an overlap region recorded by the first nozzle group and the second nozzle group and a first region and a second region recorded by the third nozzle group;

A≥B is satisfied, where A is a width along the second axis of the first region and the second region, and B is a width along the second axis of the overlap region;

the width B of each overlap region of the plurality of patches is recorded decreasing from a center of the second axis towards both ends; and the control unit is configured to in a first recording in which the recording head moves in a first direction along the second axis, record the overlap region with the first nozzle group and record the first region with the third nozzle group, in a second recording in which the recording head moves in a second direction along the second axis, record the overlap region with the second nozzle group and record the second region with the third nozzle group, and determine the recording timing based on a patch selected from the plurality of patches recorded on the medium.

DESCRIPTION OF EXEMPLARY EMBODIMENTS

Figure 1:
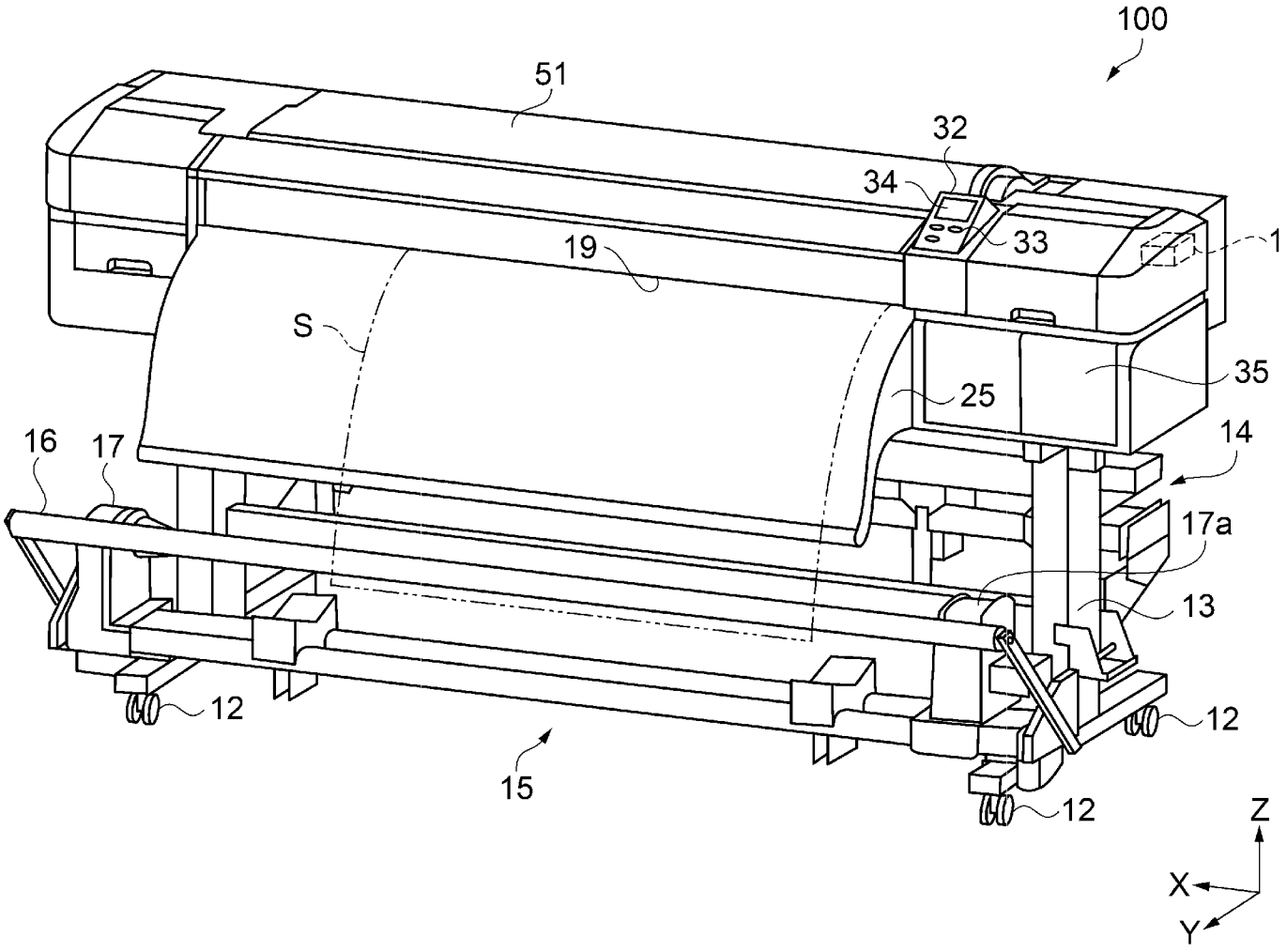
FIG. 1 is a perspective view illustrating a schematic configuration of a recording device according to an embodiment.

Exemplary embodiments of the present disclosure will be described below with reference to the accompanying drawings. Note that in the drawings bar FIGS. 5 and 9, for the sake of convenience, an X-axis, a Y-axis, and a Z-axis are illustrated as three axes perpendicular to one another. The side of the tip of the arrow illustrating each of the axes is defined as the "+ side", and the base side is defined as the "– side". The Y-axis corresponds to a first axis and is also referred to as the transport direction. The X-axis corresponds to a second axis and is also referred to as the main scanning direction.

EMBODIMENTS

Figure 2:
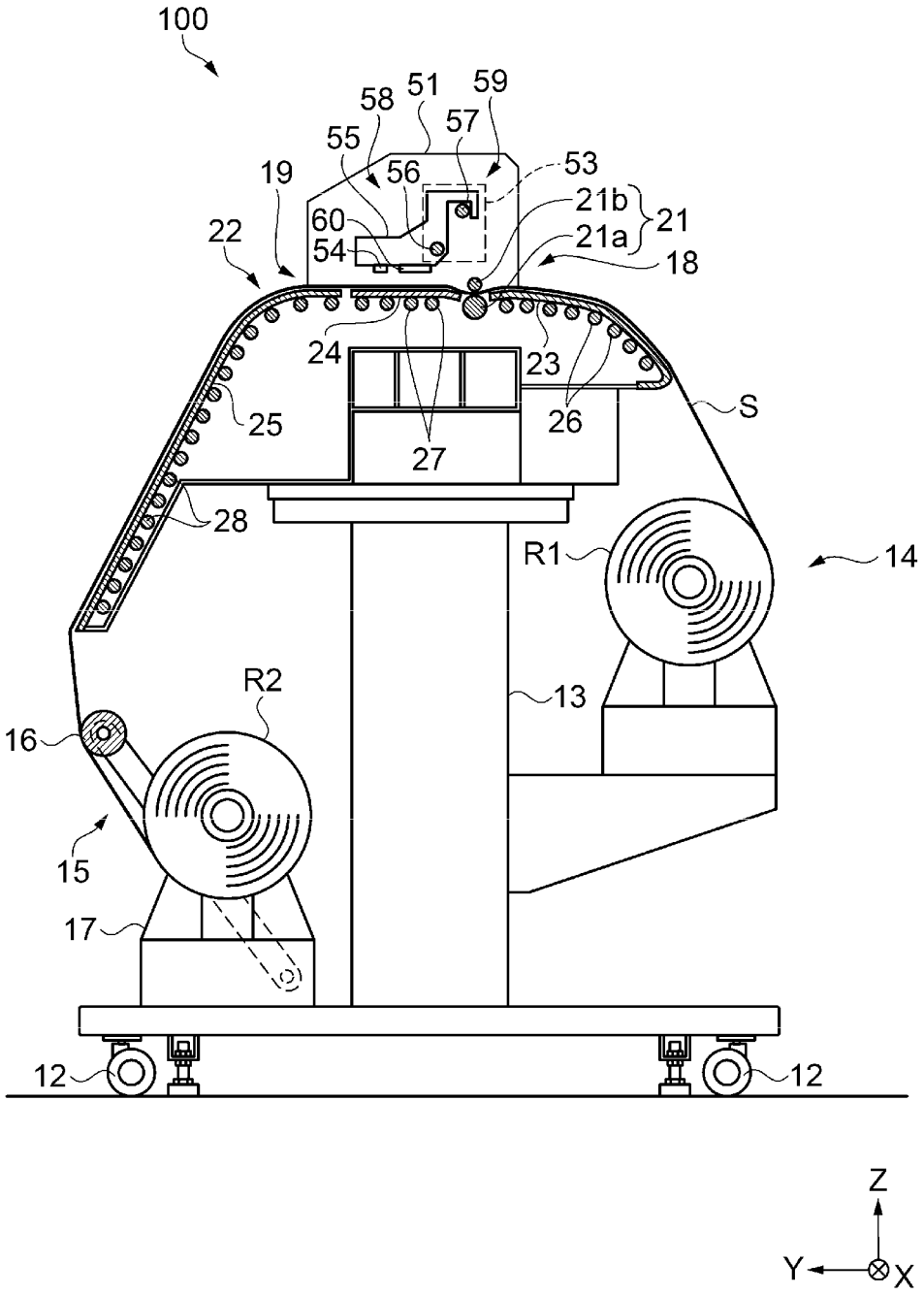
FIG. 2 is a cross-sectional view illustrating a schematic configuration of a recording device.

FIG. 1 is a perspective view illustrating a schematic configuration of a recording device according to an embodiment. FIG. 2 is a cross-sectional view illustrating a schematic configuration of the recording device. The schematic configuration of a recording device 100 according to the present embodiment will first be described with reference to FIGS. 1 and 2. Note that in the present embodiment, the ink jet-type recording device 100 is configured to form an image and the like on a medium S. The recording device 100 is a roll-to-roll type large format printer (LFP) configured to handle relatively large media.

As illustrated in FIGS. 1 and 2, the recording device 100 includes a transport roller pair 21 configured to transport the medium S in a transport direction, a medium supply unit 14 for supplying the medium S of a roll body R1 to the transport roller pair 21, a recording unit 58 configured to record on the transported medium S, and a medium winding unit 15 configured to wind into a roll the medium S printed on. The recording unit 58 is provided in a housing unit 51 with a substantially rectangular parallelepiped form. These units/portions are each supported by a pair of leg portions 13 with wheels 12 attached to a lower end of each of the leg portions 13. Note that in the present embodiment, the gravitational direction is the Z-axis, with the + side of the Z-axis being referred to as "up", and the – side being referred to as "down". The longitudinal direction of the housing unit 51 intersecting the Z-axis direction is the X-axis, with the + side of the X-axis being referred to as "left", and the – side being referred to as "right". The direction intersecting both the Z-axis and the X-axis is the Y-axis, with the + side of the Y-axis being referred to as "front", and the – side being referred to as "rear". In addition, the positional relationship along the transport direction of the medium S is also referred to as "upstream" or "downstream".

The medium supply unit 14 is provided in a rear portion of the housing unit 51. The roll body R1 of an unused medium S is held in the medium supply unit 14 in a cylindrical wound-up state. The medium supply unit 14 is configured to be mounted with the roll body R1 in a manner in which the roll body R1 can be exchanged with roll bodies R1 of various widths in the X-axis and various numbers of times wound. The medium S is unwound from the roll body R1 and fed to the recording unit 58. Note that the medium S is made of a vinyl chloride film or the like having a width of about 64 inches.

The medium winding unit 15 is provided in a front portion of the housing unit 51. At the medium winding unit 15, the medium S recorded on at the recording unit 58 is wound-up into a cylinder shape to form a roll body R2. The medium winding unit 15 includes a pair of holders 17 that sandwich a core member for winding up the medium S to form the roll body R2. One of the holders 17*a* is provided with a winding motor (not illustrated) configured to supply rotary power to the core member. The medium winding unit 15 is provided with a tension roller 16 configured to press a back surface of the medium S hanging down under its own weight and applies tension to the medium S that is wound on the medium winding unit 15.

Note that the recording device 100 of the present embodiment may be configured to discharge the medium S without winding up the medium S into the roll body R2. For example, the recorded medium S may be accommodated in a discharge basket that is attached in place of the medium winding unit 15.

The recording device 100 includes a medium guiding unit configured to support the medium S from below along a transport path 22. The medium guiding unit includes an upstream guiding unit 23, a platen 24, and a downstream guiding unit 25. The upstream guiding unit 23 is provided in a rear portion of the housing unit 51 and is configured to guide the medium S supplied from the medium supply unit 14 to the transport roller pair 21. The platen 24 is provided at a position facing the recording unit 58 and is configured to support the medium S during recording. The downstream guiding unit 25 is provided in a front portion of the housing unit 51 and is configured to guide the recorded medium S from the platen 24 to the medium winding unit 15. The upstream guiding unit 23, the platen 24, and the downstream guiding unit 25 constitute the transport path 22 of the medium S. Note that the transport direction is the Y-axis at a position where the medium S faces the recording unit 58.

The recording device 100 includes a first heater 26, a second heater 27, and a third heater 28 configured to heat the medium S. The first heater 26, the second heater 27, and the third heater 28 are, for example, tube heaters and are attached to the lower surfaces of the upstream guiding unit 23, the platen 24, and the downstream guiding unit 25 via an aluminum tape or the like. The first heater 26 preheats the medium S supported by the upstream guiding unit 23. The second heater 27 keeps the medium S on the platen 24 facing the recording unit 58 at a predetermined temperature. The third heater 28 heats the medium S supported by the downstream guiding unit 25. In this way, the ink ejected onto the medium S quickly dries and sets, and a high-quality image with little bleed-through and feathering is formed. Note that the recording device 100 may have a configuration in which a drying mechanism configured to dry the ink ejected onto the medium S is provided instead of the first heater 26, the second heater 27, and the third heater 28. Also, a configuration in which the ink ejected onto the medium S is dried naturally may also be employed.

The transport roller pair 21 extends along the X-axis and is provided between the platen 24 and the upstream guiding unit 23. The transport roller pair 21 includes a transport driving roller 21*a* for rotational driving disposed on a lower side of the transport path 22 and a transport driven roller 21*b* driven by the rotation of the transport driving roller 21*a* disposed on an upper side of the transport driving roller 21*a*. The transport driven roller 21*b* is configured to be moved away from and pressed against the transport driving roller 21*a*. When the transport driving roller 21*a* and the transport driven roller 21*b* are pressed against one another, the transport roller pair 21 sandwiches the medium S and feeds the medium S to the recording unit 58 located downstream. A transport motor (not illustrated) is provided in the housing unit 51 as a power source for outputting rotary power to the transport driving roller 21*a*. When the transport motor is driven and the transport driving roller 21*a* is driven in rotation, the medium S sandwiched between the transport driven roller 21*b* and the transport driving roller 21*a* is transported in the transport direction.

An operation panel 32 is provided at the upper right portion of the housing unit 51. The operation panel 32 includes a display unit 34 on which a recording condition setting screen and the like are displayed and an operation unit 33 that is operated when inputting a recording condition or giving instructions of various kinds. An ink mounting unit 35 where an ink cartridge (not illustrated) configured to accommodate ink is mounted is provided at a lower right portion of the housing unit 51. A plurality of ink cartridges of ink of various kinds and colors are mounted in the ink mounting unit 35. Furthermore, a control unit 1 configured to control the operation of the devices provided in each unit of the recording device 100 is provided in the housing unit 51.

The recording unit 58 is provided inside the housing unit 51. A supplying port 18 for supplying the medium S to the recording unit 58 is formed in a rear surface of the housing unit 51. Furthermore, a discharge port 19 for discharging the medium S recorded by the recording unit 58 is formed in the front surface of the housing unit 51.

The recording unit 58 is disposed above where the platen 24 is disposed. The recording unit 58 includes a recording head 60 configured to discharge ink onto the medium S transported by the transport roller pair 21 and placed on the platen 24, a carriage 55 on which the recording head 60 is mounted, a head moving unit 59 configured to move the carriage 55, and the like.

The head moving unit 59 is configured so that the carriage 55 supported on guide rails 56, 57 disposed along the X-axis and the recording head 60 mounted on the carriage 55 reciprocate along the X-axis. For the mechanism of the head moving unit 59, a mechanism including a combination of a ball screw and a ball nut, a linear guide mechanism, or the like may be employed. Furthermore, the head moving unit 59 is provided with a motor (not illustrated) as a power source for moving the carriage 55.

An adjustment mechanism 53 is provided on both end portions of the guide rails 56, 57 for adjusting the spacing distance along the Z-axis between the recording head 60 and the medium S. The surface of the carriage 55 facing the medium S is provided with a reflective sensor 54 for detecting an end portion of the medium S along the X-axis and calculating the paper width of the medium S.

Figure 3:
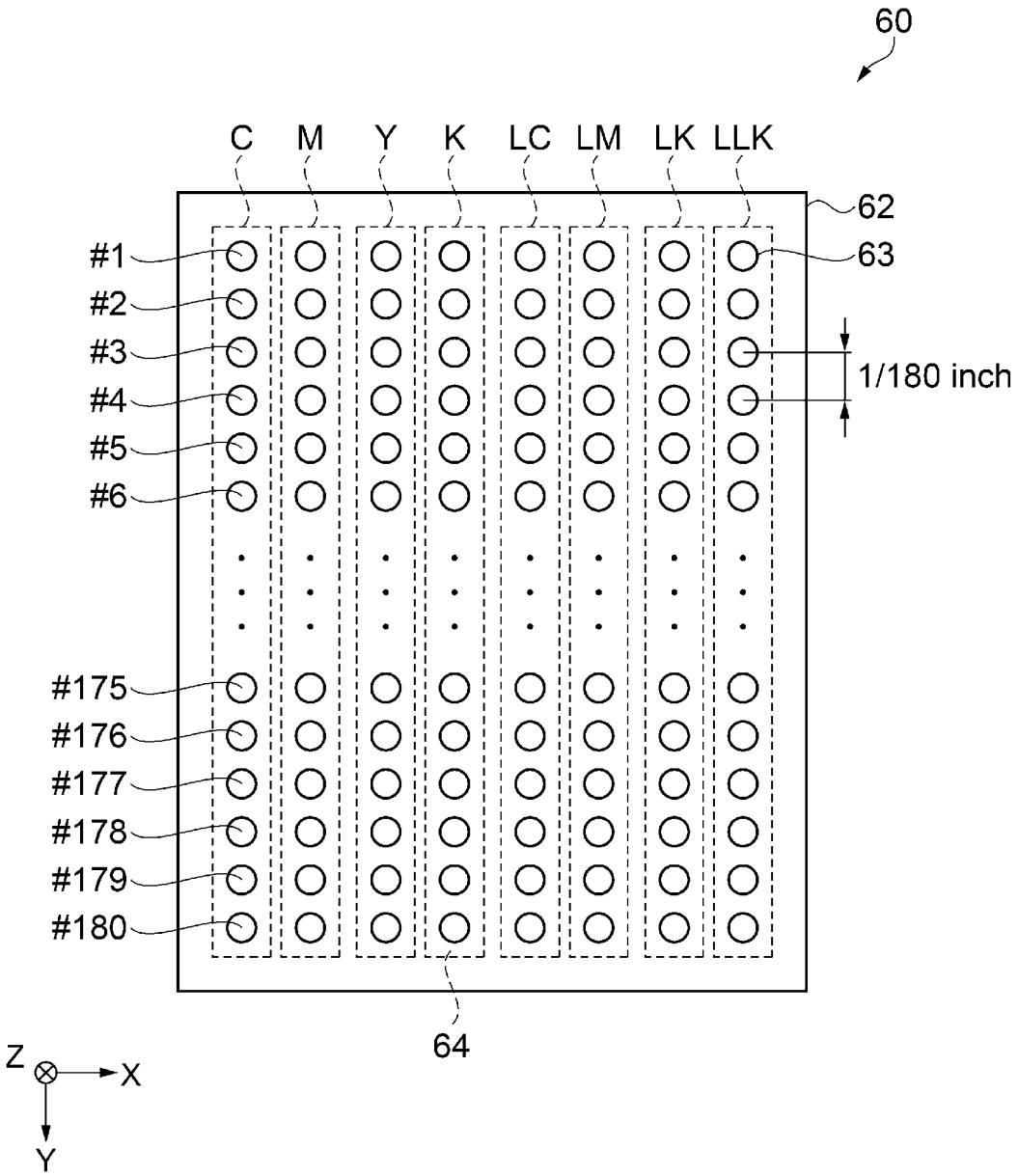
FIG. 3 is a plan view illustrating an example of a recording head.
Figure 4:
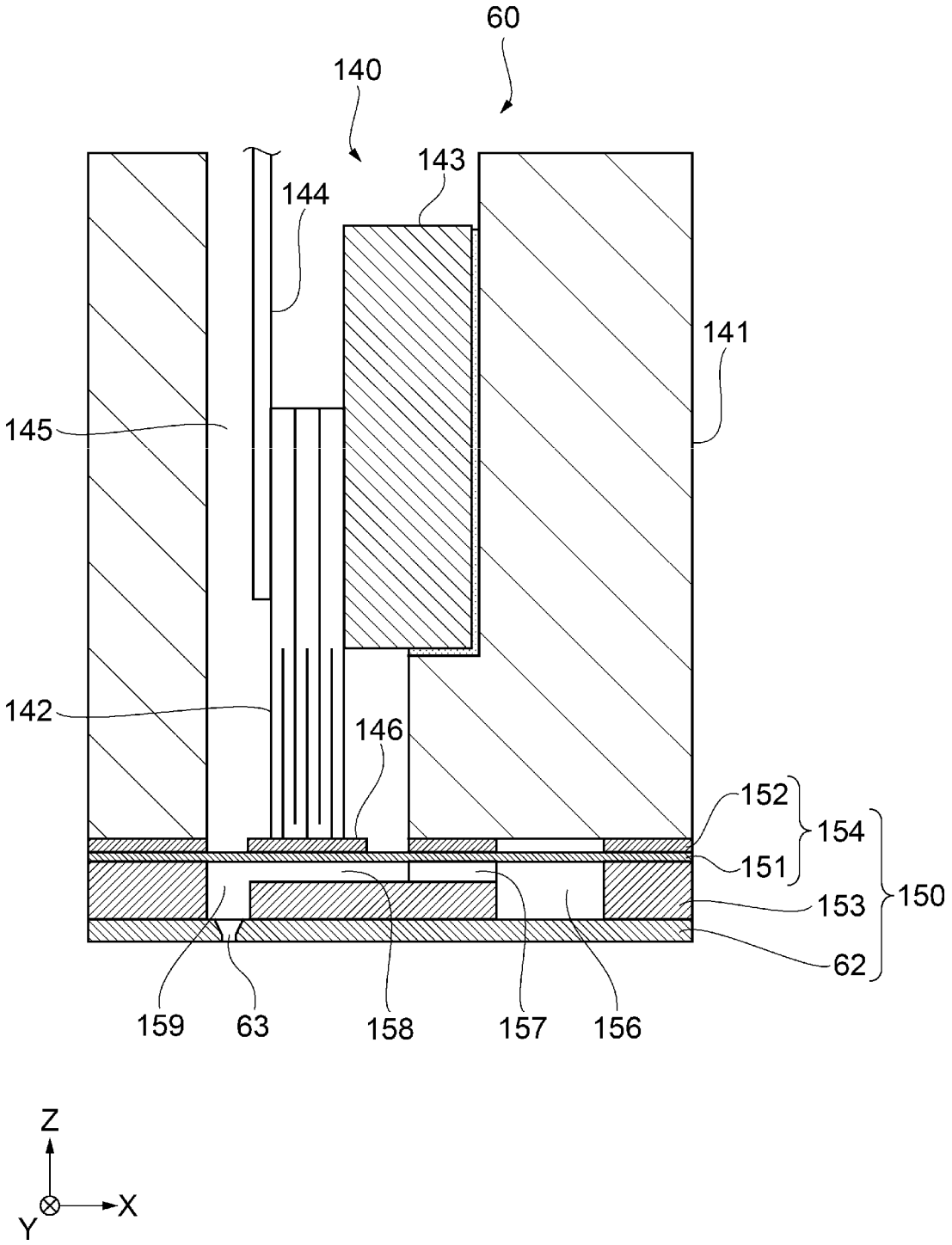
FIG. 4 is a cross-sectional view illustrating the internal configuration of a recording head.

FIG. 3 is a plan view illustrating an example of a recording head. FIG. 4 is a cross-sectional view illustrating the internal configuration of a recording head. Next, the configuration of the recording head 60 will be described with reference to FIGS. 3 and 4. As illustrated in FIG. 3, the recording head 60 includes a nozzle plate 62 on the surface facing the medium S. The nozzle plate 62 is provided with a plurality of nozzles 63 for discharging ink toward the medium S. For example, the plurality of nozzles 63 constitute eight nozzle rows 64 arranged along the X-axis, and each of the nozzle rows 64 discharge ink of a different color. In the present embodiment, the eight nozzle rows 64 correspond to ink colors of dark cyan (C), dark magenta (m), yellow (Y), dark black (K), light cyan (LC), light magenta (LM), light black (LK), and light light black (LLK).

Each nozzle row 64 is, for example, constituted by 180 nozzles 63 indicated by nozzle numbers #1 to #180 aligned along the Y-axis at a nozzle pitch of 180 dpi (dots per inch). Note that the number of nozzles 63 constituting each of the nozzle rows 64, the number of nozzle rows 64, the nozzle pitch, and the ink type here are examples and no such limitation is intended. Furthermore, the nozzle rows 64 have been described as discharging ink of different colors, but the nozzle rows 64 may discharge a penetrant liquid that promotes the penetration of the ink into the medium S or a protective liquid that protects the surface of the image recorded on the medium S. Additionally, the recording head 60 may be a head unit with a plurality of recording heads arranged in a staggered manner along the Y-axis.

As illustrated in FIG. 4, the recording head 60 includes a vibrator unit 140 including, as a unit, a plurality of piezoelectric vibrators 142, a fixing plate 143, a flexible cable 144, and the like, a case 141 configured to accommodate the vibrator unit 140, and a flow path unit 150 bonded to the lower end surface of the case 141. The case 141 is a block member made of a synthetic resin and is provided with an accommodation space portion 145 that is open at the upper end and the lower end of the case 141. The vibrator unit 140 is accommodated and fixed in the accommodation space portion 145.

The piezoelectric vibrators 142 are each formed in a comb-tooth shape elongated in a longitudinal direction. The piezoelectric vibrators 142 are layered type piezoelectric vibrators each including piezoelectric elements and inner electrodes alternately layered, and are longitudinal-vibration-mode piezoelectric vibrators stretchable in the Z-axis direction, i.e., the longitudinal direction orthogonal to layer direction. Then, a lower end surface of each of the piezoelectric vibrators 142 is bonded to an island portion 146 of the flow path unit 150. Note that the piezoelectric vibrators 142 behave in a manner similar to capacitors. That is, when supply of a signal is stopped, the potential of the piezoelectric vibrators 142 are maintained at potentials used immediately before the supply of a signal is stopped.

The flow path unit 150 includes the nozzle plate 62 disposed on one side of a flow path forming substrate 153 on the lower surface of the flow path forming substrate 153 and an elastic plate 154 disposed on the side opposite the nozzle plate 62 on the upper surface of the flow path forming substrate 153. The nozzle plate 62 is bonded to the flow path forming substrate 153 via an adhesive member. As the adhesive member, an epoxy adhesive, an acrylic adhesive, or the like can be adopted.

The nozzle plate 62 is composed of thin stainless steel or silicon formed by the plurality of nozzles 63 arranged along the Y-axis. The flow path forming substrate 153 is a plate member provided with a series of ink flow paths including a common ink chamber 156, an ink supplying port 157, a pressure chamber 158, and a nozzle communication port 159. For example, the flow path forming substrate 153 is prepared by etching a silicon wafer. The elastic plate 154 is a composite plate material with a double layer structure including a resin film 151 laminated on a support plate 152 made of stainless steel. The island portion 146 is formed by annularly removing a portion of the support plate 152 corresponding to the pressure chamber 158.

The series of ink flow paths passing from the common ink chamber 156, through the pressure chamber 158, to the nozzles 63 are formed for each of the nozzles 63. Then, the piezoelectric vibrators 142 are electrically charged and discharged and thus, the piezoelectric vibrators 142 deform. That is, charging makes the longitudinal-vibration-mode piezoelectric vibrators 142 contract along the Z-axis, i.e., in the longitudinal direction of the piezoelectric vibrators 142, and discharging makes them stretch along the Z-axis. Accordingly, when the potential rises through charging, the island portion 146 is pulled toward the piezoelectric vibrators 142 side, and the resin film 151 around the island portion 146 deforms, and then the pressure chamber 158 expands. Moreover, when the potential lowers through discharging, the pressure chamber 158 contracts. In this way, by controlling the potential of the piezoelectric vibrators 142 and contracting the piezoelectric vibrators 142 immediately after the pressure chamber 158 is expanded, pressure variations can be generated in the ink remaining in the pressure chamber 158. These pressure variations cause the ink to be discharged from the nozzle 63 in droplets to form dots on the medium S.

Note that in the present embodiment, a configuration using the piezoelectric vibrators 142 of a longitudinal vibration type is described as an example, but not such limitation is intended. For example, the piezoelectric vibrator may be a transverse vibration that bends and deforms with a layer structure including a lower electrode, a piezoelectric layer, and an upper electrode. Additionally, the recording head may have a configuration that employs a so-called electrostatic type actuator configured to generate static electricity between a vibrating plate and an electrode to deform the vibrating plate by electrostatic force, and to cause droplets to be discharged. Furthermore, recording head may have a configuration that employs a heating element to generate bubbles in the nozzles, and to cause droplets to be discharged by the bubbles.

In the present embodiment, a LFP in which the long-length medium S is supplied via a roll method and transported by the transport roller pair 21 transports LFP has been described as an example of a recording device, but no such limitation is intended. For example, the recording device may have a belt transportation configuration in which the medium is adhered to an endless transporting belt and the transporting belt is rotated to transport the medium or flatbed configuration in which the recording head moves relative to the medium placed on a placement portion. In addition, the supply of the medium may have a single-sheet configuration in which short sheet paper cut to a predetermined length is supplied.

Figure 5:
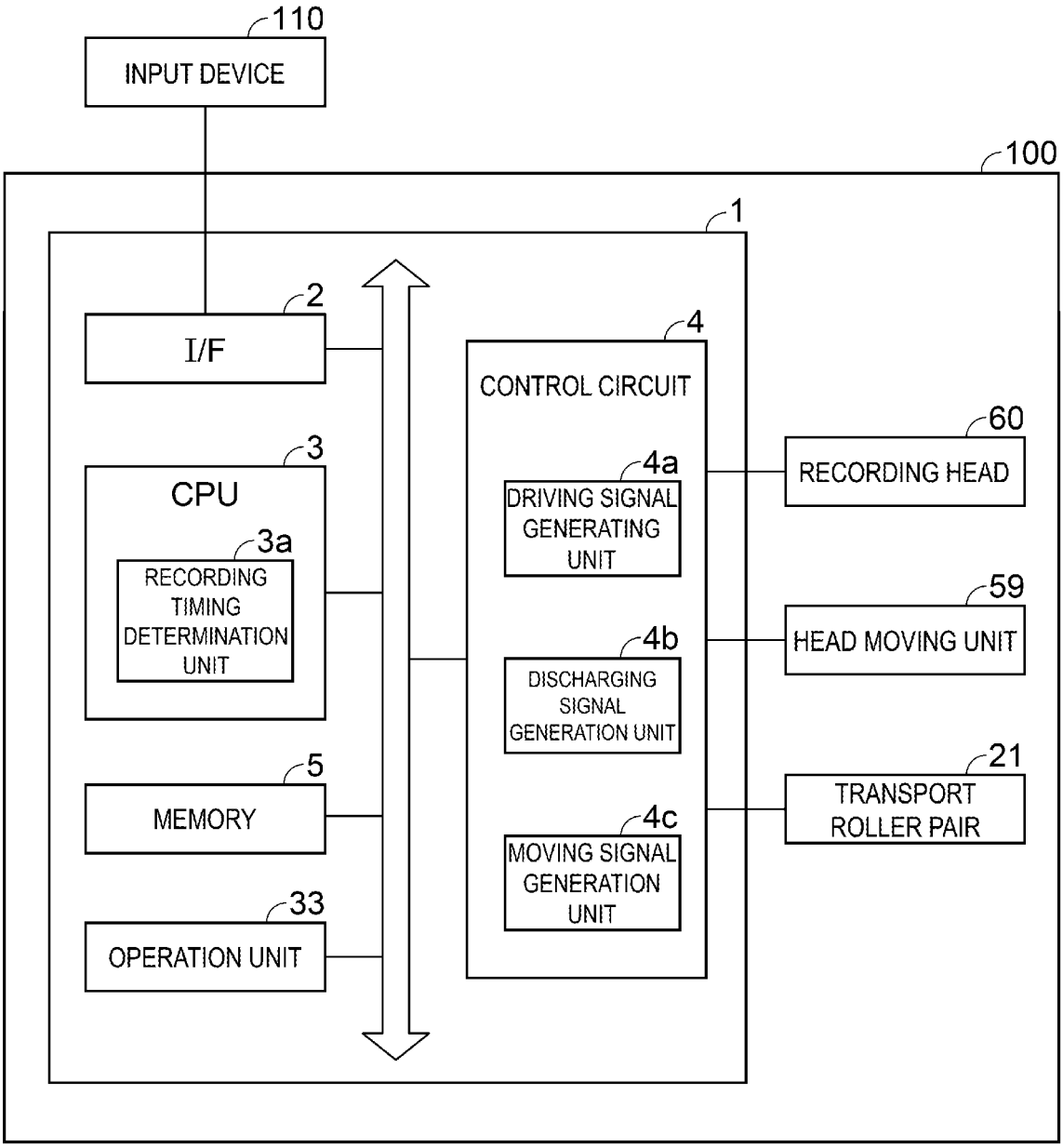
FIG. 5 is a block diagram illustrating a schematic configuration of a recording device.

FIG. 5 is a block diagram illustrating a schematic configuration of a recording device. Next, an electrical configuration of the recording device 100 will be described with reference to FIG. 5.

The recording device 100 is configured to record images and the like on the medium S based on the recorded data input to an input device 110. The input device 110 may be a personal computer or the like, and may have a configuration in which it is provided in the same housing as the recording device 100. The input device 110 is configured to control jobs related to recording by the recording device 100 and to control the recording device 100 in coordination with the control unit 1 of the recording device 100. Software operated by the input device 110 includes general image processing application software for handling image data and printer driver software for generating recorded data to make the recording device 100 perform recording.

The recording device 100 includes the control unit 1 configured to control the units included in the recording device 100. The control unit 1 is configured to include an interface unit (I/F) 2, a central processing unit (CPU) 3, a control circuit 4, memory 5, the operation unit 33, and the like.

The interface unit 2 is configured to transmit and receive data flowing between the input device 110 handling input signals and images and the control unit 1 and receive recorded data and the like generated at the input device 110.

The CPU 3 is an arithmetic processing device for performing various input signal processings, and an overall control of the recording device 100 in accordance with programs stored in the memory 5 and recorded data received from the input device 110. The CPU 3 includes a recording timing determination unit 3*a* configured to determine the recording timing of the recording head 60 described below.

The memory 5, which serves as a storage medium that ensures an area for storing the programs, a work area, and the like of the CPU 3, includes a storage device such as a Random Access Memory (RAM), an Electrically Erasable Programmable Read Only Memory (EEPROM), or the like. The operation unit 33 is configured to receive inputs such as a recording condition and various types of instructions and convert the input into an electrical signal.

The control circuit 4 is a circuit configured to generate control signals for controlling the recording head 60, the head moving unit 59, the transport roller pair 21, and the like based on the recorded data and a calculation result of the CPU 3. The control circuit 4 includes a driving signal generation unit 4*a*, a discharging signal generation unit 4*b*, and a moving signal generation unit 4*c*.

The driving signal generation unit 4*a* is a circuit configured to generate a driving control signal for driving the piezoelectric vibrators 142 associated with each of the nozzles 63. Droplets are discharged from the nozzles 63 by applying the generated driving signal to the piezoelectric vibrators 142.

The discharging signal generation unit 4*b* is a circuit configured to generate discharging control signals for controlling the selection of the nozzles 63 to discharge ink, the recording timing for discharging the ink, and the like based on the recorded data and a calculation result of the CPU 3.

The moving signal generation unit 4*c* is a circuit configured to generate moving control signals for driving the head moving unit 59 and the transport roller pair 21 based on the recorded data and a calculation result of the CPU 3.

The control unit 1, via control signals output from the control circuit 4, forms on the medium S a raster line of dots aligned along the X-axis by performing a main scan in which the carriage 55 is moved along the X-axis, i.e., the main scanning direction, while discharging ink from the nozzles 63. Additionally, the control unit 1 performs sub scanning by moving the medium S along the Y-axis, i.e. the transport direction, via a control signal output from the control circuit 4. By alternately performing main scanning and sub scanning, a desired image based on the image data is recorded on the medium S. Note that in the following description, the main scanning is also referred to as a "pass".

Next, normal recording operation of the recording device 100 will be described.

Figure 6:
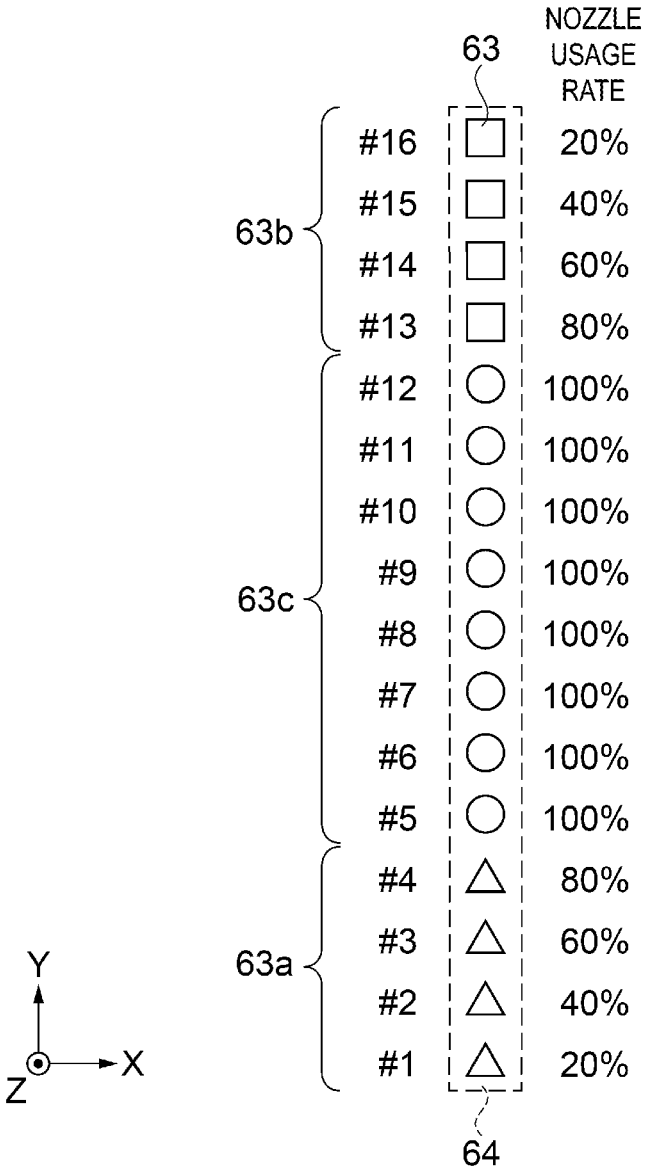
FIG. 6 is a diagram illustrating the configuration of a nozzle row for describing a recording operation.
Figure 7:
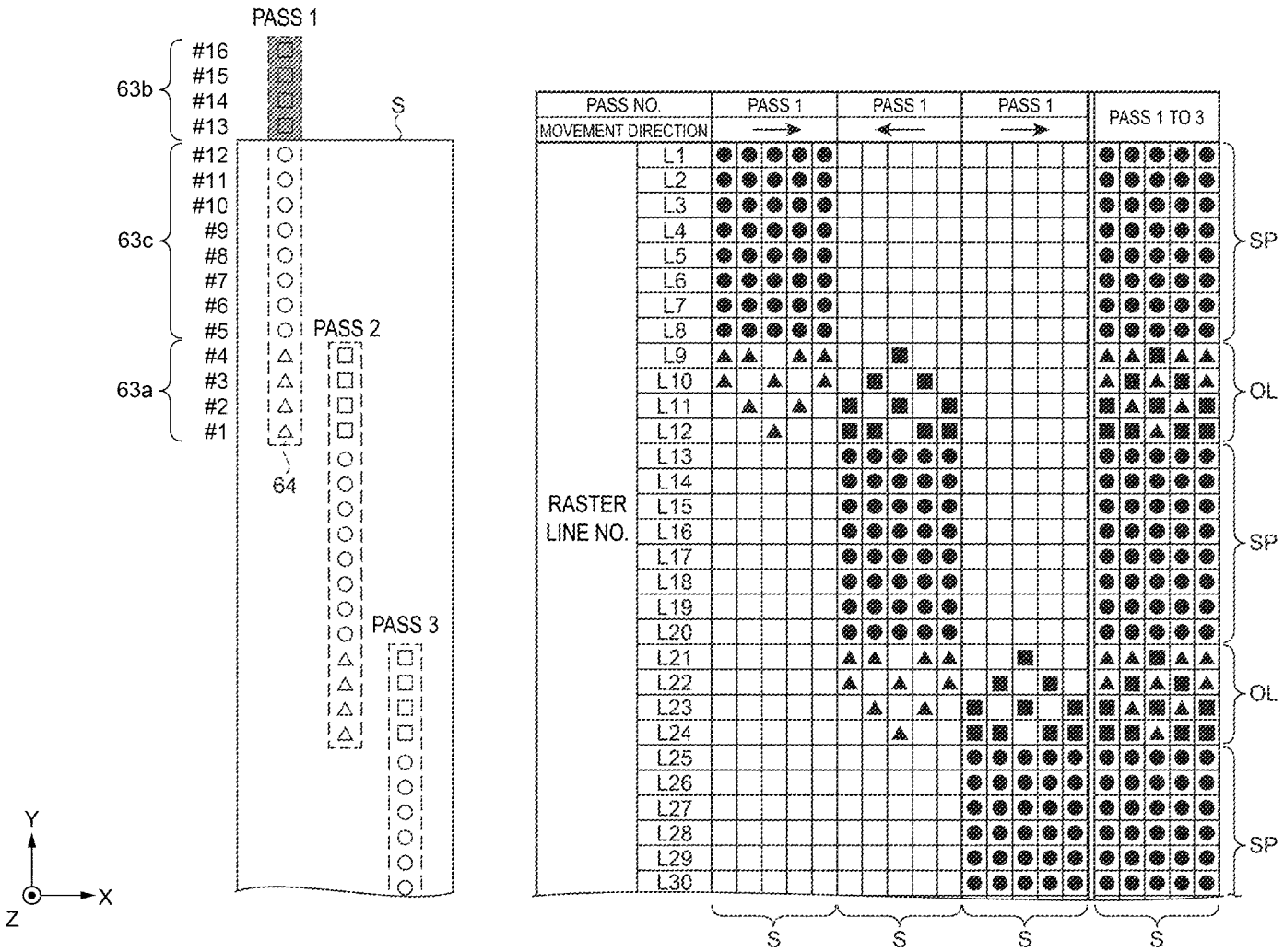
FIG. 7 is a diagram for describing the positional relationship between a nozzle row and a medium and a recording result.

FIG. 6 is a diagram illustrating the configuration of a nozzle row for describing a recording operation. FIG. 7 is a diagram for describing the positional relationship between the nozzle row and the medium and a recording result. Note that the nozzle rows illustrated in FIGS. 6 and 7 are illustrate with the nozzles being transparent from the + side to the − side of the Z-axis.

As illustrated in FIG. 6, for convenience of explanation, the recording head 60 is constituted by a single nozzle rows 64 including 16 nozzles 63 with the nozzle numbers #1 to #16. The nozzle row 64 includes a first nozzle group 63*a* including the nozzles 63 with the nozzle numbers #1 to #4, a second nozzle group 63*b* including the nozzles 63 with the nozzle numbers #13 to #16, and a third nozzle group 63*c* including the nozzles 63 with the nozzle numbers #5 to #12. Note that in FIGS. 6 and 7, the nozzles 63 belonging to the first nozzle group 63*a* are indicated by "white triangles", the nozzles 63 belonging to the second nozzle group 63*b* are indicated by "white squares", and the nozzles 63 belonging to the third nozzle group 63*c* are indicated by "white circles". In the following description, when the nozzle number of the nozzle 63 is specified, it is described as, for example, "nozzle #1" for the nozzle 63 with the nozzle number #1.

The nozzles 63 belonging to the first nozzle group 63*a* and the second nozzle group 63*b* discharge ink at a nozzle usage rate of from 20% to 80%, and the nozzles 63 belonging to the third nozzle group 63*c* discharge ink at a nozzle usage rate of 100%. The nozzle usage rate is the ratio of ink discharged to pixels per unit area at the recording resolution for the medium S. In the case of the 16 nozzles 63 illustrated in FIG. 6, the nozzle usage rate of nozzle #1 and nozzle #16 is 20%, the nozzle usage rate of nozzle #2 and nozzle #15 is 40%, the nozzle usage rate of nozzle #3 and nozzle #14 is 60%, and the nozzle usage rate of nozzle #4 and nozzle #13 is 80%. The nozzle usage rate of the nozzles #5 to #12 is 100%.

The positional relationship between the nozzle row 64 of the recording head 60 and the medium S in the case where sub scanning and main scanning are repeated three times is illustrated on the left side of FIG. 7. In FIG. 7, for example, a first main scan is indicated as "pass 1", and the corresponding pass number is indicated at the upper portion of the nozzle row 64. In FIG. 7, the nozzle row 64 of the recording head 60 is illustrated as moving with respect to the medium S, but in practice, the medium S is transported from the − side to the + side of the Y-axis with respect to the nozzle row 64. The position of the nozzle row 64 is illustrated as being shifted in the X-axis so that the position of the nozzle row 64 of each pass do not overlap, however this is not intended to illustrate the positional relationship between the nozzle row 64 and the medium S along the X-axis. Note that the region where the nozzles 63 do not discharge ink in pass 1 is indicated by black marking.

The table on the right side of FIG. 7 illustrates the dot formation position for passes 1 to 3. Note that the number of images along the X-axis of the medium S is 5 pixels, and the pixels along the Y-axis are indicated by a raster line number Ln (n=1, 2, 3 . . . ).

In the columns "Pass 1" to "Pass 3" of the table, the pixel position where ink is discharged in each pass is indicated by a dot. The dots formed by the nozzles 63 belonging to the first nozzle group 63*a* are indicated as "black triangles", the dots formed by the nozzles 63 belonging to the second nozzle group 63*b* are indicated as "black squares", and the dots formed by the nozzles 63 belonging to the third nozzle group 63*c* are indicated as "black circles". The movement direction along the X-axis of the nozzle row 64 of the recording head 60 in each pass is indicated by an arrow in the row beneath the pass number. The "Pass 1 to 3" column indicates all the dots formed in passes 1 to 3.

In pass 1, the nozzles #13 to #16 of the second nozzle group 63*b* b are not used. The medium S is transported to the position of the nozzle #12 by sub scanning along the Y-axis. In pass 1, the nozzle row 64 moves forward over the medium S, moving from the − side to the side along the X-axis, and dots are discharged at predetermined pixels of the raster lines L1 to L12. The nozzles #5 to #12 of the third nozzle group 63*c* discharge dots at all pixels forming the raster lines L1 to L8 at a nozzle usage rate of 100%.

The nozzles #1 to #4 of the first nozzle group 63*a* discharge dots at the pixels forming the raster lines L9 to L12 at a nozzle usage rate of from 20% to 80%. Specifically, the nozzle #4 discharges dots at pixels of 80% of all pixels that form the raster line L9. In the present embodiment, a dot is discharged at four pixels of a total of five pixels. The nozzle #3 discharges dots at 3 pixels corresponding to 60% of all pixels that form the raster line L10. The nozzle #2 discharges dots at 2 pixels corresponding to 40% of all pixels that form the raster line L11. The nozzle #1 discharges dots at 1 pixel corresponding to 20% of all pixels that form the raster line L12.

After pass 1 is finished, the medium S is transported along the distance of eight nozzles by sub scanning.

In pass 2, the nozzle row 64 moves back over the medium S, moving from the side to the − side along the X-axis, and dots are discharged at predetermined pixels of the raster lines L9 to L24.

The nozzles #13 to #16 of the second nozzle group 63*b* discharge dots at the pixels forming the raster lines L9 to L12 at a nozzle usage rate of from 80% to 20%. Specifically, the nozzle #16 discharges dots at 1 pixel where dots where not discharged during pass 1 corresponding to 20% of all pixels that form the raster line L9. The nozzle #15 discharges dots at 2 pixels where dots where not discharged during pass 1 corresponding to 40% of all pixels that form the raster line L10. The nozzle #14 discharges dots at 3 pixels where dots where not discharged during pass 1 corresponding to 60% of all pixels that form the raster line L11. The nozzle #13 discharges dots at 4 pixels where dots where not discharged during pass 1 corresponding to 80% of all pixels that form the raster line L12.

The nozzles #5 to #12 of the third nozzle group 63*c* discharge dots at all pixels forming the raster lines L13 to L20 at a nozzle usage rate of 100%.

The nozzles #1 to #4 of the first nozzle group 63*a* discharge dots at the pixels forming the raster lines L21 to L24 at a nozzle usage rate of from 20% to 80%. The number of dots that form the raster lines L21 to L24 are the same as that of pass 1 and as such description thereof will be omitted.

After pass 2 is finished, the medium S is transported along the distance of twelve nozzles by sub scanning.

In pass 3, the nozzle row 64 moves forward, and dots are discharged at predetermined pixels of the raster lines L21 to L36 (not illustrated). The number of dots that form the raster lines L21 to L36 are the same as that of pass 2 and as such description thereof will be omitted. Thereafter, sub scanning and passes are alternately performed.

As indicated in the "Pass 1 to 3" column in FIG. 7, by alternately performing sub scanning and passes, dots can be formed at all pixels. On the medium S, pixels are formed in a first pass region SP where one raster line is recorded in one pass and an overlap region OL where POL recording is performed to form one raster line in two passes of moving forward then backward. By using the first nozzle group 63*a* at one end portion of the nozzle row 64 and the second nozzle group 63*b* at the other end portion of the nozzle row 64 to form the overlap regions OL, lines and irregularities that appear at the junction of the nozzle row 64 can be made difficult to visually recognize. In the recording operation, excluding the overlap regions OL, the raster lines are basically formed in one forward or backward pass. This enhances recording speed. In the description below, the recording operation is referred to as "1 Pass Bi-d recording".

The recording device 100 that performed Bi-d recording records a test pattern constituted of a plurality of patches and performs adjustment of the recording timing of forward movement and backward movement using the selected patch to perform Bi-d adjustment of aligning a landing position of ink discharged during forward movement and a landing position of ink discharged during backward movement. Note that recording timing adjustment refers to adjusting the time when potential is applied to the piezoelectric vibrators 142 in order to discharge ink from the nozzles 63. Determining the recording timing refers to determining this time.

Figure 13:
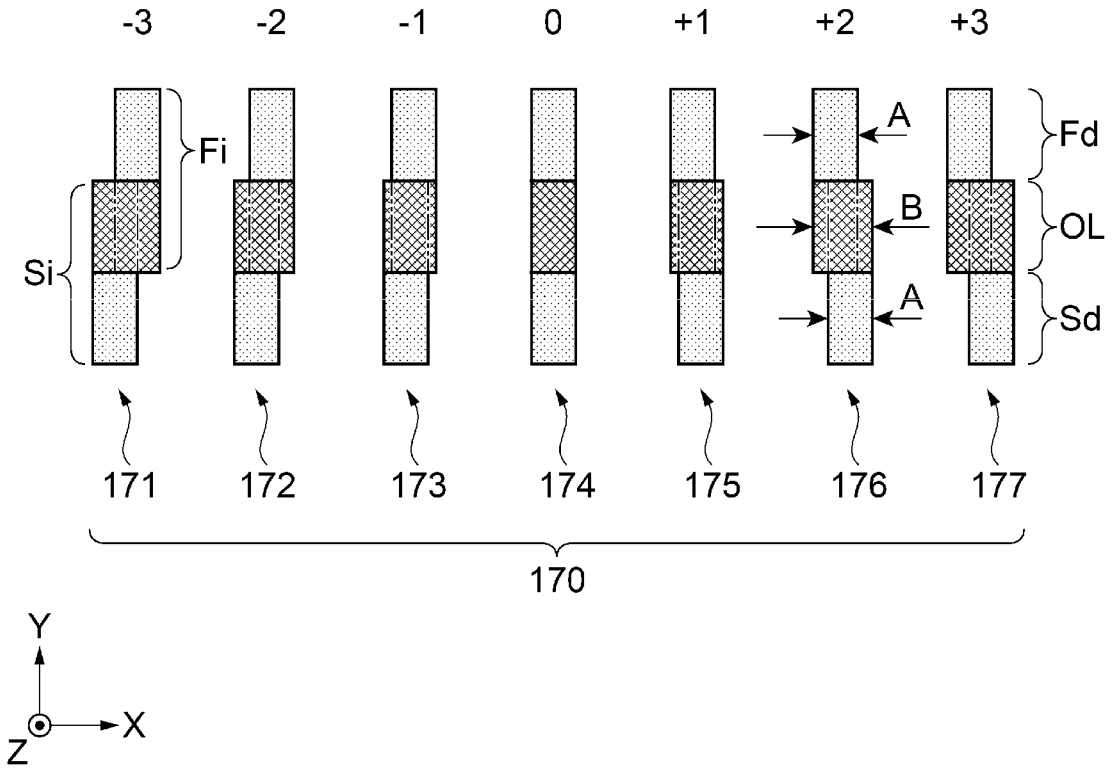
FIG. 13 is a diagram for describing an example of a test pattern from the related art.
Figure 14:
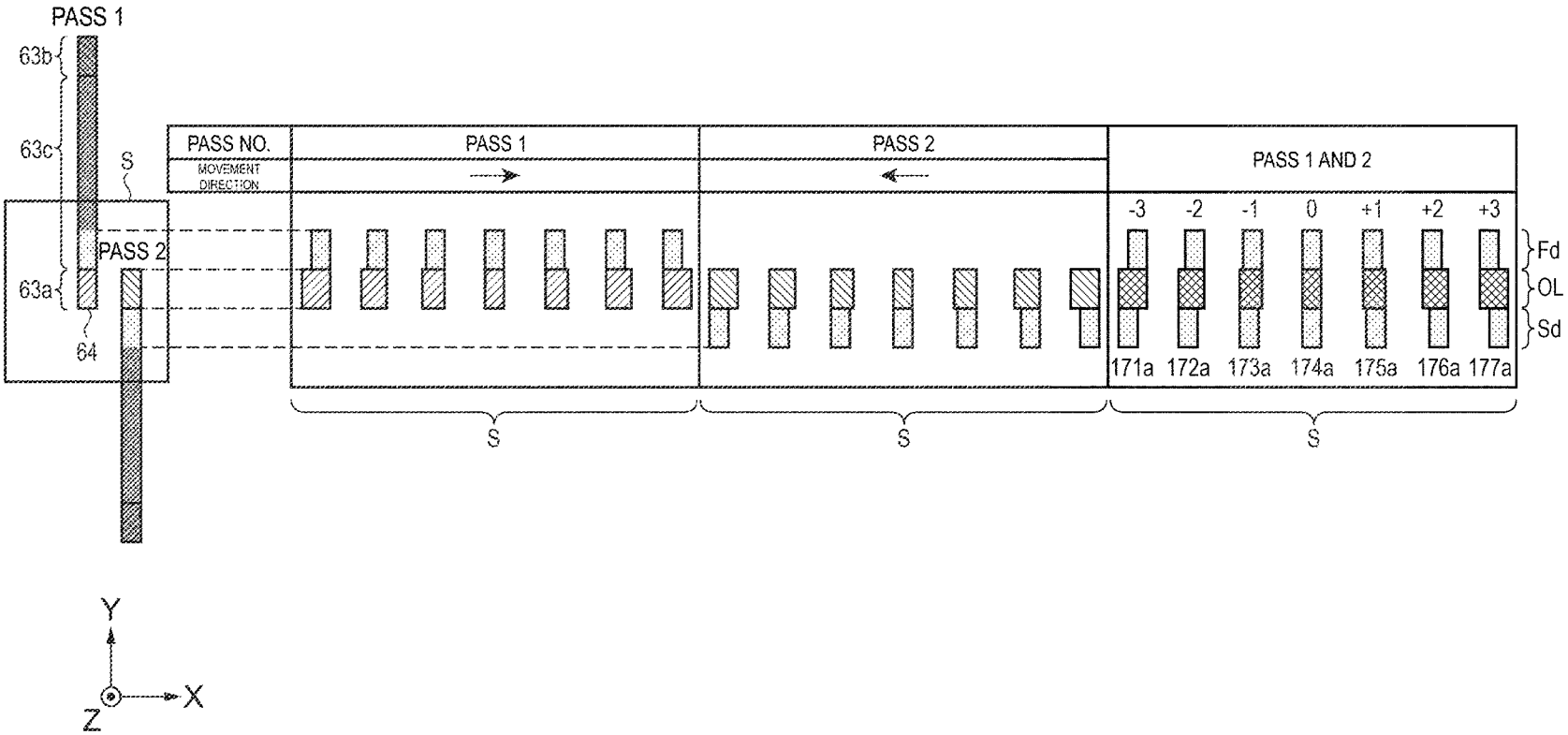
FIG. 14 is a diagram for describing a recording method of a test pattern using 1 Pass Bi-d.
Figure 15:
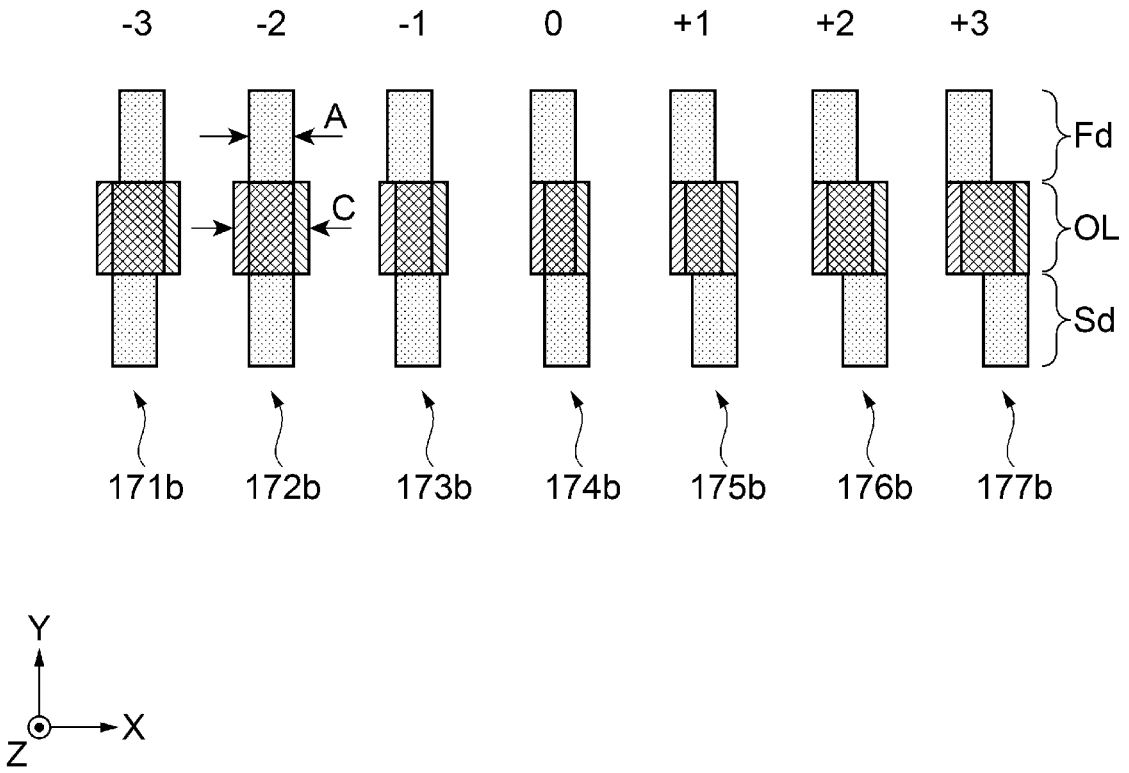
FIG. 15 is a diagram for describing an example of a test pattern recorded on a medium.

An example of a known used test pattern 170 will now be described with reference to FIGS. 13 to 15. FIG. 13 is a diagram for describing an example of a test pattern from the related art. FIG. 14 is a diagram for describing a recording method of a test pattern using 1 Pass Bi-d. FIG. 15 is a diagram for describing an example of a test pattern recorded on a medium.

As illustrated in FIG. 13, the test pattern 170, i.e., the recorded data, is composed of a plurality of patches 171 to 177 arranged along the X-axis. In the case of 1 Pass Bi-d described above, only raster lines of the overlap region OL are formed by two passes, a forward and a backward pass. To record the test pattern 170 for Bi-d adjustment, the first nozzle group 63*a* and the second nozzle group 63*b* that form the overlap region OL are required to be used.

Each patch 171 to 177 includes a first region Fd along the Y-axis, the overlap region OL, and a second region Sd. Each patch 171 to 177 is a combination of a rectangular first rectangular first rectangle image Fi long along the Y-axis formed in the first region Fd and the overlap region OL and a rectangular second rectangle image Si long along the Y-axis formed in the overlap region OL and the second region Sd. The first rectangle image Fi and the second rectangle image Si are the same shape and overlap in the overlap region OL.

The patches 171 to 177 are equally spaced along the X-axis. For the patches 171 to 177, B≥A is satisfied, where A is the width along the X-axis of the first region Fd and the second region Sd and B is the width along the X-axis of the overlap region OL. The widths B of the overlap regions of the patches 171 to 177 increase toward the ends along the X-axis. Specifically, the patch 174 is centrally located along the X-axis, and the X-axis positions of the first rectangle image Fi and the second rectangle image Si are the same. In other words, of the patches 171 to 177, only in the patch 174 does the image position of the first region Fd and the image position of the second region Sd coincide with one another. From the patch 171 to the patch 173, the position of the second rectangle image Si relative to the first rectangle image Fi shifts to the − side along the X-axis, and the offset amount thereof is greater the further the patch is disposed on the − side. From the patch 175 to the patch 177, the position of the second rectangle image Si relative to the first rectangle image Fi shifts to the + side along the X-axis, and the offset amount thereof is greater the further the patch is disposed on the + side.

The test pattern 170 is formed in two passes, a forward movement and a backward movement.

The positional relationship between the nozzle row 64 and the medium S is illustrated on the left side of FIG. 14. The "Pass 1" column on the right side of FIG. 14 illustrates the recording result of pass 1. The "Pass 2" column illustrates the recording result of pass 2. The "Pass 1 and 2" column illustrates the shape of the test pattern 170 formed on the medium S in two passes. In FIG. 14, the display of the nozzles 63 and dots is omitted. In addition, the region of the nozzle row 64 that does not discharge ink is indicated by black marking.

The diagonal down-left hatching in FIGS. 14 and 15 indicates a portion recorded by the first nozzle group 63*a*. The diagonal down-right hatching indicates a portion recorded by the second nozzle group 63*b*. The dotted-line hatching indicates a portion recorded by the third nozzle group 63*c*. Additionally, the lattice hatching indicates a portion POL recorded by the first nozzle group 63*a* and the second nozzle group 63*b*.

In pass 1, an image is formed on the medium S by forward movement. In pass 1, of the images of the patches 171 to 177 illustrated in FIG. 13, the images belonging to the first region Fd are formed by the third nozzle group 63*c* at a nozzle usage rate of 100%, and the images belonging to the overlap region OL are formed by the first nozzle group 63*a* at a nozzle usage rate of from 80% to 20%.

In pass 2, an image is formed on the medium S by backward movement. In pass 2, of the images of the patches 171 to 177 illustrated in FIG. 13, the images belonging to the second region Sd are formed by the third nozzle group 63*c* at a nozzle usage rate of 100%, and the images belonging to the overlap region OL are formed by the second nozzle group 63*b* at a nozzle usage rate of from 20% to 80%.

When the recording position for forward movement and the recording position for backward movement match, i.e., the landing position of ink discharged during forward movement matches the landing position of ink discharged during backward movement, as illustrated in the "Pass 1 and 2" column in FIG. 14, recorded patches 171*a* to 177*a* recorded on the medium S have the same shape as the patches 171 to 177 of the recorded data illustrated in FIG. 13. The patch recorded on the medium S is referred to as a "recorded patch".

As illustrated in FIG. 15, when the landing position of ink discharged during forward movement and the landing position of ink discharged during the backward movement are offset, recorded patches 171*b* to 177*b* recorded on the medium S have a different shape to the patches 171 to 177. In FIG. 15, the recording timing for pass 2 is faster than that for the image recorded in pass 1, and the entire image illustrated in the "Pass 2" column of FIG. 14 is offset to the + side along the X-axis. Accordingly, the POL recorded image of the overlap region OL is recorded widened in the X-axis. Specifically, of the recorded patches 171*b* to 177*b*, only in the recorded patch 172*b* do the image position of the first region Fd and the image position of the second region Sd coincide with one another. In the overlap region OL of the recorded patch 172*b*, the POL recorded portion indicated by the lattice hatching and the non-POL recorded portions indicated by the diagonal down-right hatching and the diagonal down-left hatching on either side along the X-axis are recorded. Thus, in the recorded patch 172*b* in which the image position of the first region Fd and the image position of the second region Sd match, a width C of the overlap region is recorded wider than the width A of the first region Fd and the second region Sd.

For Bi-d adjustment, the recorded patch 172*b* in which the image position of the first region Fd and the image position of the second region Sd match is selected. However, for a recording device prior to Bi-d adjustment, the patches 171 to 177 in the related art are recorded widened along the X-axis in the images of the overlap region OL. This has made selection of an optimal patch difficult.

Figure 8:
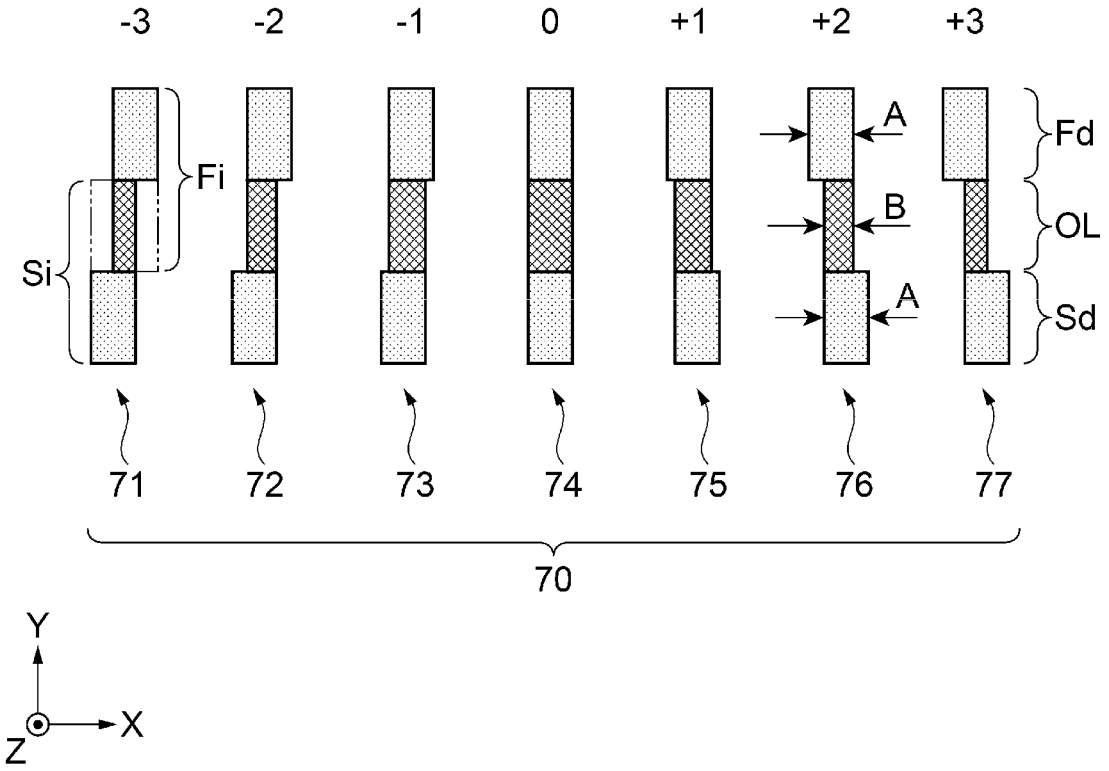
FIG. 8 is a diagram for describing a shape of a test pattern.

Next, a test pattern of the present embodiment will be described with reference to FIG. 8. FIG. 8 is a diagram for describing a shape of a test pattern.

As illustrated in FIG. 8, a test pattern 70 is composed of a plurality of patches 71 to 77 arranged along the X-axis. Each patch 71 to 77 includes the first region Fd along the Y-axis, the overlap region OL, and the second region Sd. In the patches 71 to 77 of the present embodiment; the image shapes of the overlap region OL differ than those of the patches 171 to 177 in the related art. In the patches 71 to 77, only the portions where the first rectangle image Fi and the second rectangle image Si overlap form the image shape of the overlap region OL.

The patches 71 to 77 are equally spaced along the X-axis. For the patches 71 to 77, $A \geq B \geq A/2$ is satisfied, where A is the width along the X-axis of the first region Fd and the second region Sd and B is the width along the X-axis of the overlap region OL. The widths B of the overlap regions of the patches 71 to 77 decrease from the center toward the ends along the X-axis. Specifically, the patch 74 is centrally located along the X-axis, and the X-axis positions of the first rectangle image Fi and the second rectangle image Si are the same. That is, the width B of the patch 74 matches the width A. In other words, of the patches 71 to 77, only in the patch 74 do the image position of the first region Fd and the image position of the second region Sd coincide with one another along the X-axis.

From the patch 71 to the patch 73, the position of the second rectangle image Si relative to the first rectangle image Fi shifts to the − side along the X-axis, and the offset amount thereof is greater the further the patch is disposed on the − side. From the patch 75 to the patch 77, the position of the second rectangle image Si relative to the first rectangle image Fi shifts to the + side along the X-axis, and the offset amount thereof is greater the further the patch is disposed on the + side. Specifically, the width B of the patch 74, which is the central patch centrally disposed along the X-axis, is B=A. The width B of the patch 71, which is an end portion patch disposed on the − side end portion along the X-axis, and the width B of the patch 77, which is an end portion patch disposed on the + side end portion along the X-axis, is B=A/2. In the X-axis, the plurality of patches 71 to 77 are symmetrically shaped and are disposed in symmetrical positions with respect to the patch 74. Note that the number and shape of the patches of the test pattern are examples and not such limitation is intended.

Figure 9:
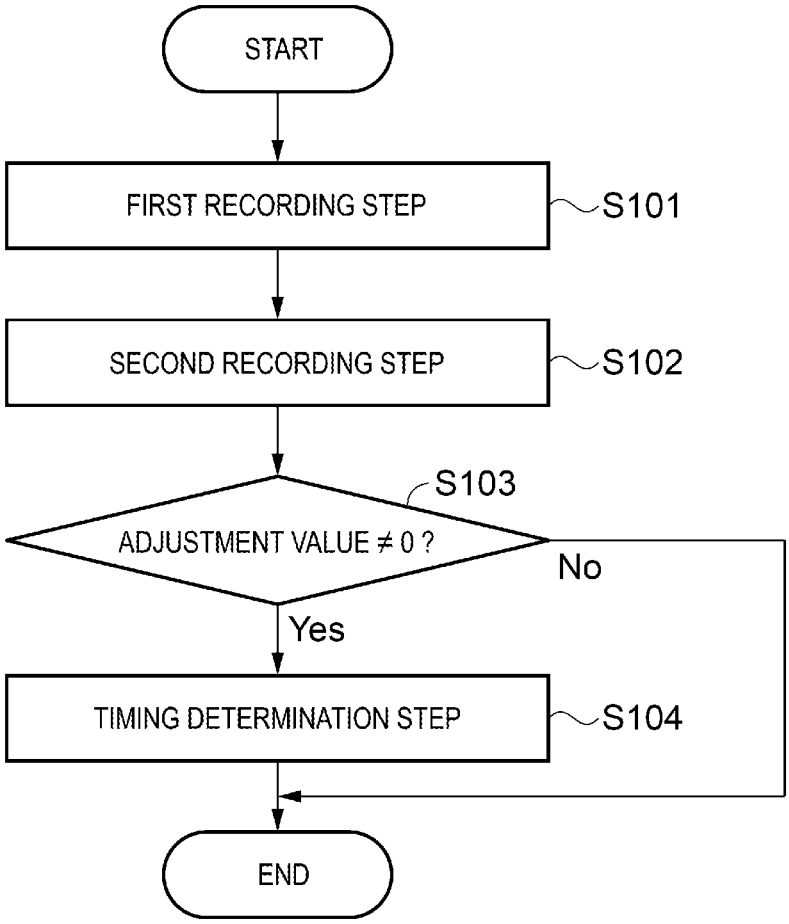
FIG. 9 is a flowchart for describing a method for determining a recording timing.
Figure 10:
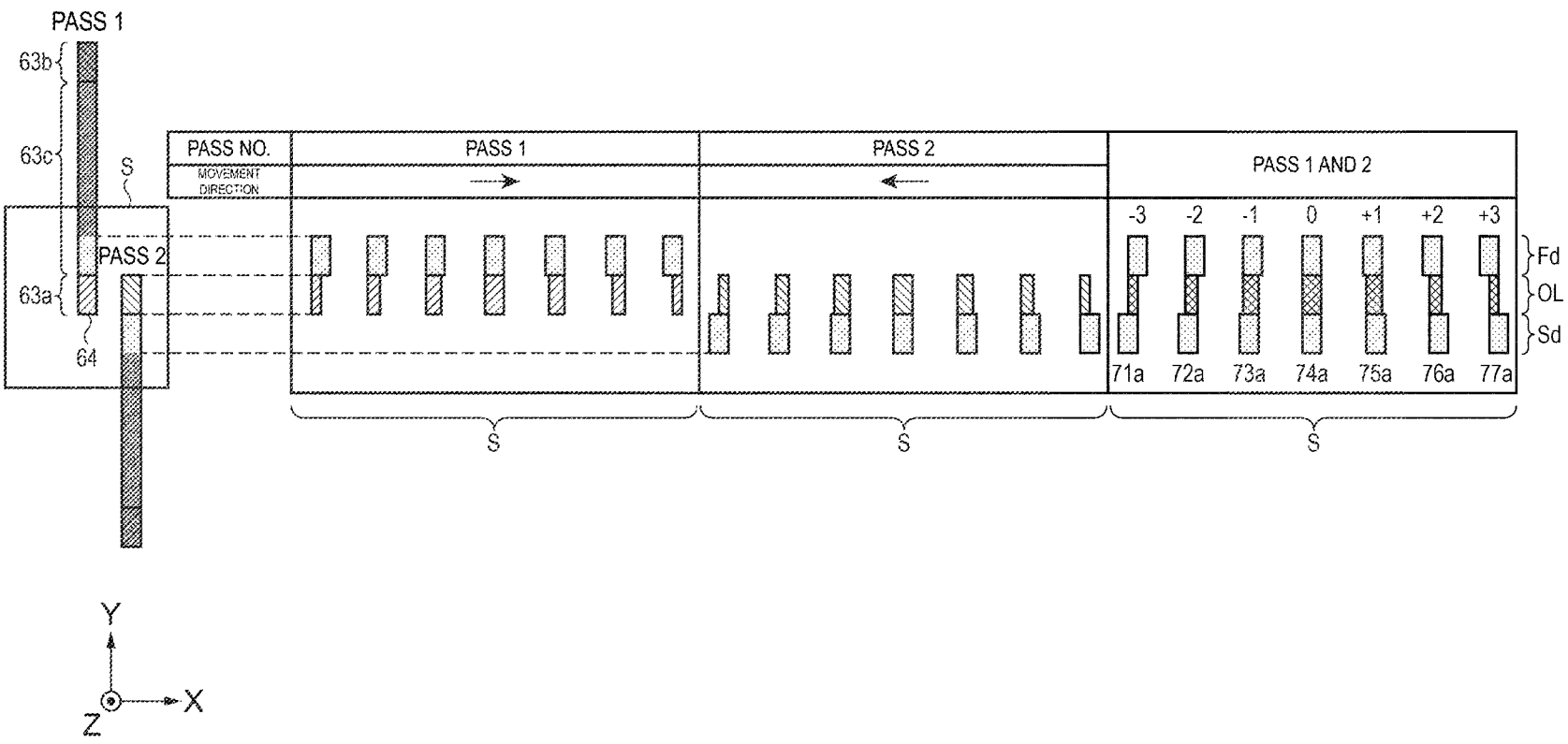
FIG. 10 is a diagram for describing a recording method of a test pattern using 1 Pass Bi-d.
Figure 11:
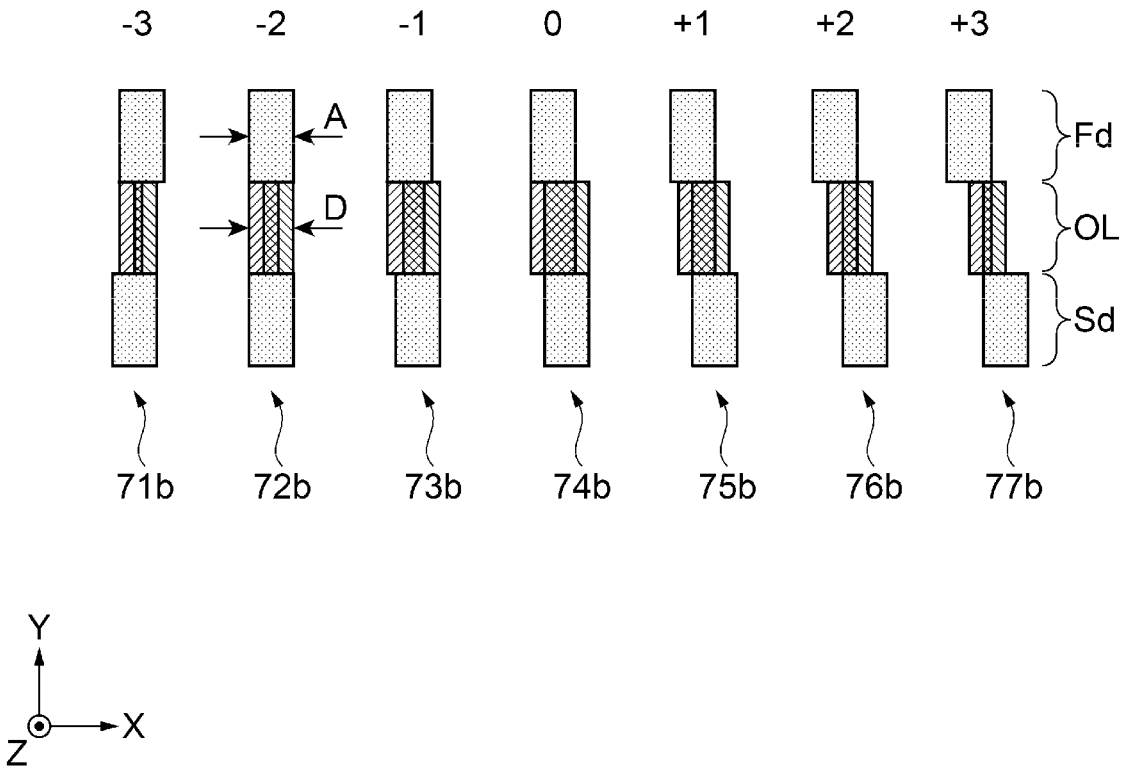
FIG. 11 is a diagram for describing an example of a test pattern recorded on a medium.

Next, a method for determining a recording timing of the recording device 100 will be described with reference to FIGS. 9 to 11. FIG. 9 is a flowchart for describing the method for determining a recording timing. FIG. 10 is a diagram for describing a recording method of a test pattern using 1 Pass Bi-d. FIG. 11 is a diagram for describing an example of a test pattern recorded on a medium. The description method used for FIGS. 10 and 11 is the same as that for FIGS. 14 and 15, and thus descriptions thereof will be omitted. A first recording step and a second recording step depicted in FIG. 9 are recording steps in which the plurality of patches 71 to 77 are recorded on the medium S.

Step S101 is the first recording step, in which the control unit 1 records the overlap region OL via the first nozzle group 63*a* and the first region Fd via the third nozzle group 63*c* in pass 1, i.e., first recording, of moving forward the nozzle rows 64 of the recording head 60. In pass 1, of the images of the patches 71 to 77, the images belonging to the first region Fd are formed by the third nozzle group 63*c* at a nozzle usage rate of 100%, and the images belonging to the overlap region OL are formed by the first nozzle group 63*a* at a nozzle usage rate of from 80% to 20%. The recording results in the first recording step are illustrated in the "Pass 1" column of FIG. 10.

Step S102 is the second recording step, in which the control unit 1 records the overlap region OL via the second nozzle group 63*b* and the second region Sd via the third nozzle group 63*c* in pass 2, i.e., second recording, of moving backward the nozzle rows 64 of the recording head 60. In pass 2, of the images of the patches 71 to 77, the images belonging to the second region Sd are formed by the third nozzle group 63*c* at a nozzle usage rate of 100%, and the images belonging to the overlap region OL are formed by the second nozzle group 63*b* at a nozzle usage rate of from 20% to 80%. The recording results in the second recording step are illustrated in the "Pass 2" column of FIG. 10.

When the landing position of ink discharged during forward movement matches the landing position of ink discharged during backward movement, as illustrated in the "Pass 1 and 2" column in FIG. 10, recorded patches 71*a* to 77*a* recorded on the medium S have the same shape as the patches 71 to 77 illustrated in FIG. 8.

When the landing position of ink discharged during forward movement and the landing position of ink discharged during the backward movement are offset, as illustrated in FIG. 11 for example, recorded patches 71*b* to 77*b* recorded on the medium S have a different shape to the patches 71 to 77. In FIG. 11, the recording timing for pass 2 is faster than that for the image recorded in pass 1, and the entire image illustrated in the "Pass 2" column of FIG. 10 is offset to the + side along the X-axis.

Step S103 is a determination step for determining whether an adjustment value other than 0 is input. The adjustment value is a value corresponding to the recorded patch selected from the recorded patches recorded on the medium S in the recording steps. The corresponding adjustment values are indicated at the upper portion of the recorded patch for each patch 71 to 77. Of the recorded patches, the recorded patch in which the image position of the first region Fd and the image position of the second region Sd match is selected. For example, in the case of the recorded patches 71*a* to 77*a* illustrated in "Pass 1 and 2" in FIG. 10, the recorded patch 74*a* is selected and a corresponding adjustment value of "0" is input from the operation unit 33. For example, in the case of the recorded patches 71*b* to 77*b* illustrated FIG. 11, the recorded patch 72*b* is selected and a corresponding adjustment value of "−2" is input from the operation unit 33.

The selection of the recorded patch can be performed visually by the user of the recording device 100. As illustrated in FIG. 11, when the patches 71 to 77 of the present embodiment are used, if the landing position of ink discharged during forward movement and the landing position of ink discharged during backward movement are offset, The width D of the overlap region OL of the recorded patch 72*b* in which the image position of the first region Fd and the image position of the second region Sd is substantially the same as the width A of the first region Fd and the second region Sd. Thus, the recorded patch 172*b* in which the image position of the first region Fd and the image position of the second region Sd match can be easily found. In addition, because the patches 71 to 77 are disposed symmetrically with respect to the patch 74 as a central patch, an optimal recorded patch 72*b* can be easily selected.

If the input adjustment value is a value other than "0" (step S103: Yes), then the flow proceeds to step S104. If the input adjustment value is "0" or if nothing is input to the operation unit 33 (step S103: No), the flow ends.

Step S104 is a timing determination step in which the control unit 1 determines the recording timing of the recording head 60 based on the selected recorded patch. The operation unit 33 converts the input adjustment value to an electrical signal. Based on the input adjustment value, the CPU 3 changes the recording timing for forward movement and/or the recording timing for backward movement, and determines a recording timing where the landing position of ink discharged during forward movement and the landing position of ink discharged during backward movement match. The discharging signal generation unit 4*b* generates a discharging control signal for discharging ink from each nozzle 63 based on the determined recording timing. Thus, the image position recorded by forward movement and the image position recorded by backward movement coincide along the X-axis, and an image is recorded faithful to the recorded data input from the input device 110.

Note that the selection of an optimal recorded patch and the input of an adjustment value are described as being performed by the user, but no such limitation is intended. For example, the recording device may include a scanner configured to read an image, and the control unit 1 or input device 110 may select the optimal recorded patch 72*b* by comparing the image data of the recorded patches 71*b* to 77*b* read by the scanner with the image data of the patch 74 and determine the corresponding adjustment value. The image data of the recorded patches 71*b* to 77*b* may be read by a scanner provided outside of the recording device 100 and input via the input device 110.

The width B of the patch 71 and the patch 77, which are end portion patches, is preferably equal to the maximum difference along the X-axis between the landing position of ink discharged during forward movement and the landing position of ink discharged during backward movement, that is, the maximum amount of landing deviation of the recording device 100. Accordingly, out of the recorded patches 71*b* to 77*b* recorded on the medium S, an optimal recorded patch in which the image position of the first region Fd and the image position of the second region Sd match along the X-axis is formed. Thus, an optimal recording timing can be determined by performing the flow of the method for determining the recording timing illustrated in FIG. 9 once.

In addition, the control unit 1 performs control such that the amount of ink of the overlap region OL is greater than that of the first region Fd and the second region Sd. For example, as illustrated in FIG. 11, along the X-axis, the width D of the overlap region OL of the recorded patch 72*b* in which the image position of the first region Fd and the image position of the second region Sd match is the same as the width A of the first region Fd and the second region Sd. However, the landing position during forward movement and the landing position during backward movement are offset, so the amount of ink of a non-overlap portion where no overlap is present is reduced. For example, in the overlap region OL illustrated in FIG. 11, the amount of ink used is less for the portions that were not POL recorded indicated by diagonal down-right and diagonal down-left hatching than for the first region Fd and the second region Sd. In the recording of the test pattern 70, the recording device 100 uses the recorded data for the patches 71 to 77 in which the amount of ink in the overlap region OL is increased compared to that of a normal recording. Thus, the amount of ink of the overlap region OL that is not POL recorded increases and the difference in concentration between the first and second regions Fd, Sd and portions not POL recorded is reduced, so that the optimal recorded patch 72*b* can be easily selected. To increase in the amount of ink, the nozzle usage rate may be changed of the size of the ink droplets discharged from the nozzle 63 may be changed.

Next, a recording of a test pattern using 3 Pass Bi-d will be described. Although the 1 Pass Bi-d recording has been described above, the test pattern 70 illustrated in FIG. 8 can be used in a method for determining a recording timing that is Bi-d adjustment of an odd number Pass Bi-d recording.

Figure 12:
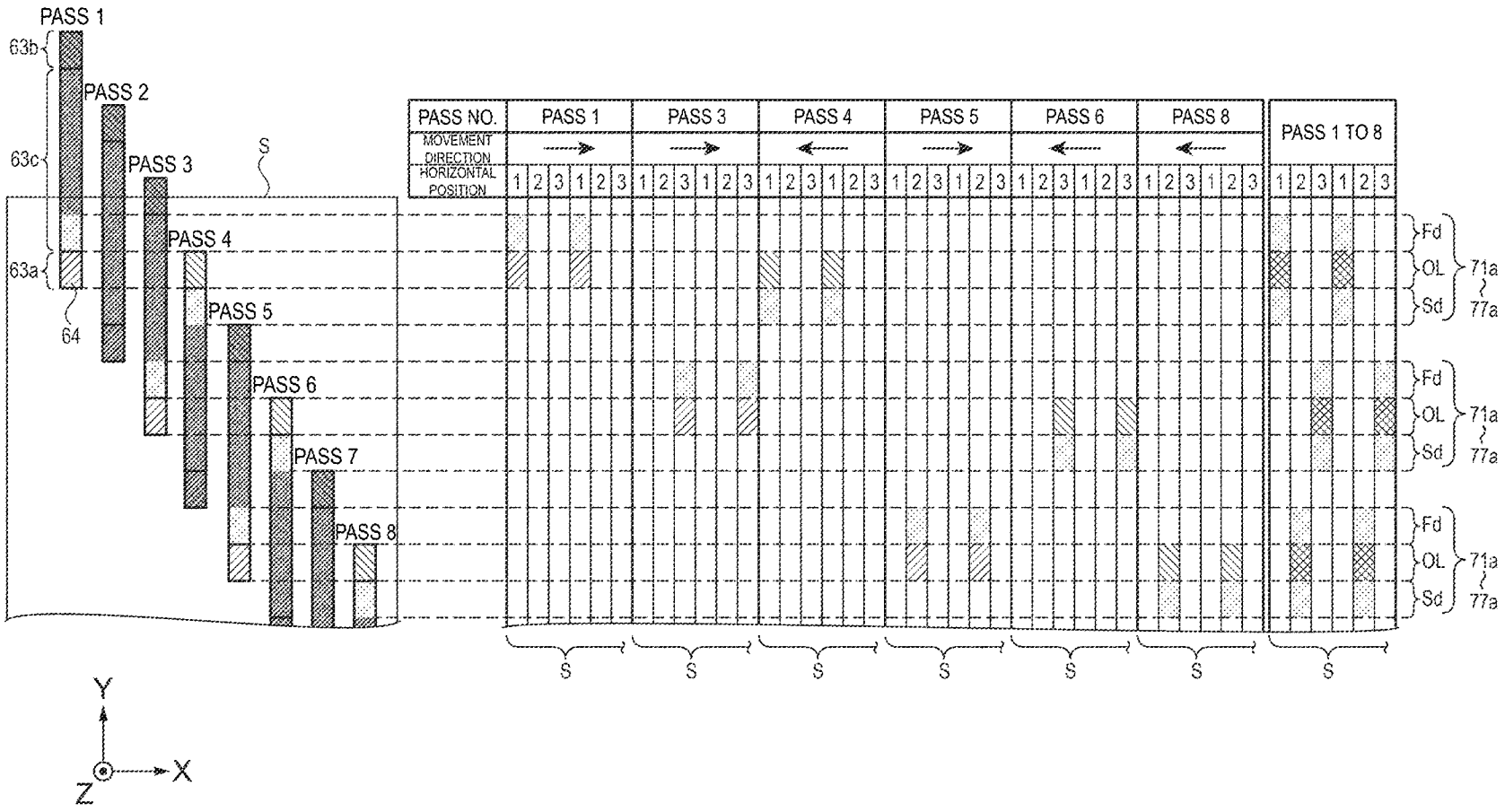
FIG. 12 is a diagram for describing a recording method of a test pattern using 3 Pass Bi-d.

FIG. 12 is a diagram for describing a recording method of a test pattern using 3 Pass Bi-d. The positional relationship between the nozzle row 64 and the medium S is illustrated on the left side of FIG. 12. The "Pass 1" column to the "Pass 8" column on the right side of FIG. 12 illustrate the pixels where the test pattern 70 is recorded in each pass. The "Pass 1 to 8" column illustrates the pixel positions recorded in eight passes. In FIG. 12, the display of the nozzles 63 and dots is omitted. In addition, the region of the nozzle row 64 that does not discharge ink is indicated by black marking. Also, the display of the "Pass 2" column and the "Pass 7" column in which an image is not recorded is omitted. In addition, in the following description, the recorded patches 71*a* to 77*a* are formed by the patches 71 to 77.

The diagonal down-left hatching in FIG. 12 indicates the horizontal position of a pixel recorded by the first nozzle group 63*a*. The diagonal down-right hatching indicates the horizontal position of a pixel recorded by the second nozzle group 63*b*. The dotted-line hatching indicates the horizontal position of a pixel recorded by the third nozzle group 63*c*. Additionally, the lattice hatching indicates the horizontal position of a pixel POL recorded by the first nozzle group 63*a* and the second nozzle group 63*b*.

In 3 pass Bi-d recording, excluding the overlap regions OL, the raster lines are basically formed in three forward or backward passes. Specifically, the pixels along the X-axis are repeatedly arranged into three types of pixels indicated by the horizontal positions 1 to 3. In FIG. 12, due to the constraints of the paper, a maximum of two pixels are illustrated per horizontal position. In pass 1, pass 4, pass 7 . . . , an image is recorded in the pixels at the horizontal position 1. In pass 2, pass 5, pass 8 . . . , an image is recorded in the pixels at the horizontal position 2. In pass 3, pass 6, pass 9 . . . , an image is recorded in the pixels at the horizontal position 3. Note that in the 3 Pass Bi-d recording, the transport amount of the medium S by the sub scanning is ⅓ of the transport amount when performing 1 Pass Bi-d recording. The overlap region OL is formed by, for example, the first nozzle group 63*a* in pass 1 and the second nozzle group 63*b* in pass 4.

In pass 1, an image is formed on the medium S by forward movement. In pass 1, of the images of the patches 71 to 77, the images belonging to the first region Fd are formed at the pixel at the horizontal position 1 by the third nozzle group 63*c* at a nozzle usage rate of 100%, and the images belonging to the overlap region OL are formed at the pixel at the horizontal position 1 by the first nozzle group 63*a* at a nozzle usage rate of from 80% to 20%.

In pass 2, an image is formed on the medium S by backward movement. In recording the test pattern 70, no image is formed.

In pass 3, an image is formed on the medium S by forward movement. In pass 3, of the images of the patches 71 to 77, the images belonging to the first region Fd are formed at the pixel at the horizontal position 3 by the third nozzle group 63*c* at a nozzle usage rate of 100%, and the images belonging to the overlap region OL are formed at the pixel at the horizontal position 3 by the first nozzle group 63*a* at a nozzle usage rate of from 80% to 20%.

In pass 4, an image is formed on the medium S by backward movement. In pass 4, of the images of the patches 71 to 77, the images belonging to the second region Sd are formed at the pixel at the horizontal position 1 by the third nozzle group 63*c* at a nozzle usage rate of 100%, and the images belonging to the overlap region OL are formed at the pixel at the horizontal position 1 by the second nozzle group 63*b* at a nozzle usage rate of from 20% to 80%. By performing pass 1 and pass 4, the recorded patches 71*a* to 77*a* formed of only pixels at the horizontal position 1 are completed.

In pass 5, an image is formed on the medium S by forward movement. In pass 5, of the images of the patches 71 to 77, the images belonging to the first region Fd are formed at the pixel at the horizontal position 2 by the third nozzle group 63*c* at a nozzle usage rate of 100%, and the images belonging to the overlap region OL are formed at the pixel at the horizontal position 2 by the first nozzle group 63*a* at a nozzle usage rate of from 80% to 20%.

In pass 6, an image is formed on the medium S by backward movement. In pass 6, of the images of the patches 71 to 77, the images belonging to the second region Sd are formed at the pixel at the horizontal position 3 by the third nozzle group 63*c* at a nozzle usage rate of 100%, and the images belonging to the overlap region OL are formed at the pixel at the horizontal position 3 by the second nozzle group 63*b* at a nozzle usage rate of from 20% to 80%. By performing pass 3 and pass 6, the recorded patches 71*a* to 77*a* formed of only pixels at the horizontal position 3 are completed.

In pass 7, an image is formed on the medium S by forward movement. In recording the test pattern 70, no image is formed.

In pass 8, an image is formed on the medium S by backward movement. In pass 8, of the images of the patches 71 to 77, the images belonging to the second region Sd are formed at the pixel at the horizontal position 2 by the third nozzle group 63*c* at a nozzle usage rate of 100%, and the images belonging to the overlap region OL are formed at the pixel at the horizontal position 2 by the second nozzle group 63*b* at a nozzle usage rate of from 20% to 80%. By performing pass 5 and pass 8, the recorded patches 71*a* to 77*a* formed of only pixels at the horizontal position 2 are completed.

As described above, the recorded patches 71*a* to 77*a* for the image at each horizontal position can be formed in the 3 Pass Bi-d recording. Although detailed description is omitted, the recorded patches 71*a* to 77*a* can be similarly formed in Pass Bi-d recordings of odd numbers equal to or greater than 3. Accordingly, the above-described method for determining a recording timing can be applied to the recording device 100 that performs odd number Pass Bi-d recording.

As described above, according to the method of determining a recording timing and the recording device 100 of the present embodiment, the effects below can be achieved.

The method for determining a recording timing includes a first recording step and a second recording step in which the plurality of patches 71 to 77 are recorded on the medium S and a timing determination step in which a recording timing of the recording head 60 is determined based on the selected recorded patch 72*b*. The width B of the overlap region OL of the plurality of patches 71 to 77 is less than or equal to the width A of the first region Fd and the second region Sd, regions other than the overlap region OL, and decreases toward both ends along the X-axis. In this way, for the optimal recorded patch 72*b* selected from the recorded patches 71*b* to 77*b* recorded on the medium S, the image of the overlap region OL is recorded without being widened along the X-axis, so the optimal recorded patch 72*b* can be easily selected. Accordingly, a method for determining a recording timing for determining an optimal recording timing of the recording head 60 can be provided.

In the first recording step and the second recording step, the control unit 1 performs control such that the amount of ink of the overlap region OL is greater than the amount of ink of the first region Fd and the second region Sd. Thus, the difference in concentration between the first and second regions Fd, Sd in the recorded patch 72*b* and portions not POL recorded of the overlap region OL is reduced, so that the optimal recorded patch 72*b* can be easily selected.

The width B of the patches 71 to 77, which are the end portion patches, is B=A/2 and is equal to the maximum amount of landing deviation of the recording device 100. In this way, an optimal recorded patch is included among the recorded patches 71*b* to 77*b*. Thus, an optimal recording timing can be determined by performing the flow of the method for determining the recording timing once.

Because the patches 71 to 77 are disposed symmetrically with respect to the patch 74, i.e., the central patch, an optimal recorded patch 72*b* can be easily selected.

The control unit 1 of the recording device 100 records on the medium S the plurality of patches 71 to 77 with the recording head 60, and, with the recording timing determination unit 3*a*, determines the recording timing of the recording head based on the recorded patch 72*b* selected from the plurality of recorded patches 71*b* to 77*b* recorded on the medium S. The width B of the overlap region OL of the plurality of patches 71 to 77 is less than or equal to the width A of the first region Fd and the second region Sd, regions other than the overlap region OL, and decreases toward both ends along the X-axis. In this way, for the optimal recorded patch 72*b* selected from the recorded patches 71*b* to 77*b* recorded on the medium S, the image of the overlap region OL is recorded without being widened along the X-axis, so the optimal recorded patch 72*b* can be easily selected. Accordingly, the recording device 100 for determining an optimal recording timing of the recording head 60 can be provided.

Contents derived from the Embodiments will be described below.

A method for determining a recording timing according to the present application includes:

recording on a medium a plurality of patches disposed along a second axis intersecting with a first axis with a recording head including a first nozzle group, a third nozzle group, and a second nozzle group arranged in order along the first axis; and determining a recording timing of the recording head based on a patch selected from the plurality of patches recorded on the medium; wherein the plurality of patches each include an overlap region recorded by the first nozzle group and the second nozzle group and a first region and a second region recorded by the third nozzle group;

A≥B is satisfied, where A is a width along the second axis of the first region and the second region, and B is a width along the second axis of the overlap region;

the width B of each overlap region of the plurality of patches is recorded decreasing from a center of the second axis towards both ends; and the recording includes a first recording in which the recording head moves in a first direction along the second axis and the overlap region is recorded with the first nozzle group and the first region is recorded with the third nozzle group, and a second recording in which the recording head moves in a second direction along the second axis and the overlap region is recorded with the second nozzle group and the second region is recorded with the third nozzle group.

According to this method, the method for determining a recording timing includes a recording step in which the plurality of patches are recorded on the medium and a timing determination step in which a recording timing of the recording head is determined based on the patch selected from the plurality of patches recorded on the medium. The width B of the overlap region of the plurality of patches is less than or equal to the width A of the first region and the second region, regions other than the overlap region, and decreases toward both ends along the second axis. In this way, for the optimal recorded patch selected from the patches recorded on the medium, the image of the overlap region is recorded without being widened along the second axis, so the optimal patch can be easily selected. Accordingly, a method for determining a recording timing for determining an optimal recording timing of the recording head can be provided.

In the method for determining a recording timing described above, an amount of ink of the overlap region may be greater than an amount of ink of the first region and an amount of ink of the second region.

According to this method, the optimal patch image can be easily selected because the concentration of the overlap region is increased.

In the method for determining a recording timing described above, the plurality of patches may be recorded such that B≥A/2 is satisfied; and the width B of end portion patches disposed on both ends of the plurality of patches may be B=A/2 and may be recorded to be equal to a maximum value of a difference along the second axis between a recording position from the first recording and a recording position from the second recording.

According to this method, an optimal patch is included among the plurality of patches recorded on the medium. Thus, an optimal recording timing can be determined by performing the method for determining the recording timing once.

In the method for determining a recording timing described above, the width B of a center patch centrally disposed of the plurality of patches may be recorded such that B=A is satisfied; and along the second axis, the plurality of patches may be recorded to be symmetrical with respect to the center patch.

According to this method, because the plurality of patches are disposed symmetrically with respect to the central patch, an optimal patch can be easily selected from the patches recorded on the medium.

A recording device according to the present application includes:

a recording head including a first nozzle group, a third nozzle group, and a second nozzle group arranged in order along a first axis, the recording head being configured to record on a medium a plurality of patches disposed along a second axis intersecting the first axis;

a head moving unit configured to cause a carriage, at which the recording head is mounted, reciprocate along the second axis; and a control unit including a recording timing determination unit configured to determine a recording timing of the recording head; wherein the plurality of patches each include an overlap region recorded by the first nozzle group and the second nozzle group and a first region and a second region recorded by the third nozzle group;

A≥B is satisfied, where A is a width along the second axis of the first region and the second region, and B is a width along the second axis of the overlap region;

the width B of each overlap region of the plurality of patches is recorded decreasing from a center of the second axis towards both ends; and the control unit is configured to in a first recording in which the recording head moves in a first direction along the second axis, record the overlap region with the first nozzle group and record the first region with the third nozzle group, in a second recording in which the recording head moves in a second direction along the second axis, record the overlap region with the second nozzle group and record the second region with the third nozzle group, and determine the recording timing based on a patch selected from the plurality of patches recorded on the medium.

According to this device, the control unit records on the medium the plurality of patches with the recording head, and, with the recording timing determination unit, determines the recording timing of the recording head based on the patch selected from the plurality of patches recorded on the medium. The width B of the overlap region of the plurality of patches is less than or equal to the width A of the first region and the second region, regions other than the overlap region, and decreases toward both ends along the second axis. In this way, for the optimal recorded patch selected from the patches recorded on the medium, the image of the overlap region is recorded without being widened along the second axis, so the optimal patch can be easily selected. Accordingly, the recording device for determining an optimal recording timing of the recording head can be provided.

What is claimed is:

1. A method for determining a recording timing, comprising:

a recording step for recording on a medium a plurality of patches disposed along a second axis intersecting with a first axis with a recording head including a first nozzle group, a third nozzle group, and a second nozzle group arranged in order along the first axis; and a timing determination step for determining a recording timing of the recording head based on a patch selected from the plurality of patches recorded on the medium; wherein the plurality of patches each include an overlap region recorded by the first nozzle group and the second nozzle group and a first region and a second region recorded by the third nozzle group;

the recording is performed so that A≥B is satisfied, where A is a width along the second axis of the first region and the second region, and B is a width along the second axis of the overlap region;

the width B of each overlap region of the plurality of patches is recorded decreasing from a center of the second axis towards both ends; and the recording step includes a first recording in which the recording head moves in a first direction along the second axis and the overlap region is recorded with the first nozzle group and the first region is recorded with the third nozzle group, and a second recording in which the recording head moves in a second direction along the second axis and the overlap region is recorded with the second nozzle group and the second region is recorded with the third nozzle group.

2. The method for determining a recording timing according to claim 1, wherein an amount of ink of the overlap region is greater than an amount of ink of the first region or an amount of ink of the second region.

3. The method for determining a recording timing according to claim 1, wherein the plurality of patches are recorded such that B≥A/2 is satisfied; and the width B of end portion patches disposed on the both ends of the plurality of patches is recorded such that B=A/2 and the width B is equal to a maximum value of a difference along the second axis between a recording position from the first recording and a recording position from the second recording.

4. The method for determining a recording timing according to claim 1, wherein the width B of a central patch centrally disposed of the plurality of patches is recorded such that B=A is satisfied; and along the second axis, the plurality of patches are recorded to be symmetrical with respect to the central patch.

5. A recording device, comprising:

a recording head including a first nozzle group, a third nozzle group, and a second nozzle group arranged in order along a first axis, the recording head being configured to record on a medium a plurality of patches disposed along a second axis intersecting the first axis;

a head moving unit configured to cause a carriage, at which the recording head is mounted, reciprocate along the second axis; and a control unit including a recording timing determination unit configured to determine a recording timing of the recording head; wherein the plurality of patches each include an overlap region recorded by the first nozzle group and the second nozzle group and a first region and a second region recorded by the third nozzle group;

the recording is performed so that A≥B is satisfied, where A is a width along the second axis of the first region and the second region, and B is a width along the second axis of the overlap region;

the width B of each overlap region of the plurality of patches is recorded decreasing from a center of the second axis towards both ends; and the control unit is configured to in a first recording in which the recording head moves in a first direction along the second axis, record the overlap region with the first nozzle group and record the first region with the third nozzle group, in a second recording in which the recording head moves in a second direction along the second axis, record the overlap region with the second nozzle group and record the second region with the third nozzle group, and determine the recording timing based on a patch selected from the plurality of patches recorded on the medium.

* * * * *